US006918644B2

(12) United States Patent
Aruga

(10) Patent No.: US 6,918,644 B2
(45) Date of Patent: Jul. 19, 2005

(54) IMAGE RECORDING APPARATUS

(75) Inventor: Toshinao Aruga, Akiruno (JP)

(73) Assignee: Olympus Corporation, Tokyo (JP)

( * ) Notice: Subject to any disclaimer, the term of this patent is extended or adjusted under 35 U.S.C. 154(b) by 0 days.

(21) Appl. No.: 10/823,358

(22) Filed: Apr. 13, 2004

(65) Prior Publication Data

US 2004/0196319 A1 Oct. 7, 2004

Related U.S. Application Data

(63) Continuation of application No. PCT/JP02/10652, filed on Oct. 15, 2002.

(30) Foreign Application Priority Data

Oct. 15, 2001 (JP) ..... 2001-316967

(51) Int. Cl.[7] ..... B41J 29/38
(52) U.S. Cl. ..... 347/9
(58) Field of Search ..... 347/12–14, 19, 347/6, 9, 78–81

(56) References Cited

U.S. PATENT DOCUMENTS 6,527,358 B2 * 3/2003 Kuriyama et al. ..... 347/19
2001/0043245 A1 11/2001 Endo et al.
2002/0018090 A1 2/2002 Takazawa et al.

FOREIGN PATENT DOCUMENTS

| | | | |
|---|---|---|---|
| EP | 1 059 172 | A2 | 12/2000 |
| EP | 1 127 694 | A1 | 8/2001 |
| JP | 9-94948 | A | 4/1997 |
| JP | 11-179884 | A | 7/1999 |
| JP | 11-188853 | A | 7/1999 |
| JP | 2000-52542 | A | 2/2000 |
| JP | 2001-205872 | A | 7/2001 |
| JP | 2001-277543 | A | 10/2001 |
| JP | 2001-293849 | A | 10/2001 |
| JP | 2002-120386 | A | 4/2002 |
| WO | WO 00/29219 | A1 | 5/2000 |

* cited by examiner

*Primary Examiner*—Hai Pham
(74) *Attorney, Agent, or Firm*—Frishauf, Holtz, Goodman & Chick, P.C.

(57) ABSTRACT

An image recording apparatus includes a recording head having a plurality of nozzles, a carriage, a transfer mechanism, a driving mechanism, a detection mechanism which optically detects an ink ejection state, and a controller. The plural nozzles are divided into a plurality of nozzle groups. The controller makes an ejection timing of each of the nozzle groups different from that of any other nozzle group. The shifting time of the timing of each of the nozzle group is shorter than an ejection cycle in image recording of each group.

38 Claims, 13 Drawing Sheets

IMAGE RECORDING APPARATUS

CROSS-REFERENCE TO RELATED APPLICATIONS

This is a Continuation Application of PCT Application No. PCT/JP02/10652, filed Oct. 15, 2002, which was not published under PCT Article 21(2) in English.

This application is based upon and claims the benefit of priority from prior Japanese Patent Application No. 2001-316967, filed Oct. 15, 2001, the entire contents of which are incorporated herein by reference.

BACKGROUND OF THE INVENTION

1. Field of the Invention

The present invention relates to an image recording apparatus having a detection mechanism which detects an ejection state of a nozzle.

2. Description of the Related Art

An ink jet type image recording apparatus records an image by ejecting an ink to a recording medium. The image recording apparatus has a recording head which ejects an ink to the recording medium, a carriage which holds the recording head, transferring means for transferring the recording medium, and carriage driving means for moving the carriage in a direction (main scan direction) orthogonal to a transferring direction (sub scan direction) of the recording medium by the transferring means. Further, the recording head has a plurality of nozzles which are ejection openings for the ink.

The image recording apparatus drives the carriage along the main scan direction. The recording head is moved along the main scan direction by drive of the carriage. During this movement, the recording head injects ink droplets to the recording medium. Specifically, the image recording apparatus sequentially ejects the ink from each of a plurality of the nozzles during movement of the carriage. By doing so, the image recording apparatus sequentially records a plurality of ink dots on the recording medium. The image recording apparatus forms a desired image with these ink dots.

Usually, the image recording apparatus records the ink dots D with the even arrangement as a whole as shown in FIG. 12. It is to be noted that reference character MD denotes the main scan direction and reference character SD designates the sub scan direction in FIG. 12.

As shown in FIG. 12, the respective ink dots D are recorded at intervals dl along the sub scan direction SD. Furthermore, the respective ink dots D are recorded at intervals dw along the main scan direction MD. Moreover, the interval dl and the interval dw are substantially equal to each other. Therefore, the formed image has the uniform density distribution as a whole. It is to be noted that the interval dl is determined based on a gap between the respective nozzles of the recording head. The interval dw is determined based on a moving velocity of the recording head in the main scan direction and an ejection timing of the ink. Actually, however, since an ejection cycle of the ink is determined based on the essential capability of the recording head, it is difficult to reduce the interval beyond the capability. Therefore, the interval dw is usually determined based on the moving speed of the recording head. Thus, in the regular image recording apparatus, a fixed moving speed is set in order to evenly arrange the ink dots as mentioned above. Concretely, in the image recording apparatus, the moving speed of the recording head in the usual image recording mode is set to a speed that the recording head can move for a distance corresponding to the interval dl of the nozzles in one cycle of the ejection cycle of the ink.

The quality of an image obtained by the ink dots is deteriorated when an ejection defect is generated due to clogging of the nozzles or the like.

Therefore, an image recording apparatus having a detection mechanism which detects the ejection defect is proposed. There are mainly two modes of the detection mechanism. The detection mechanism of the first mode performs test printing on the recording medium, and detects an ejection defect by reading a test-printed image by using a scanner.

The detection mechanism of the second mode has a light source and a photo detecting element which receives a beam from the light source. The light source is arranged in such a manner that the ink droplet ejected from the recording head can be transmitted through the beam. The detection mechanism of the second mode detects an ejection defect by detecting a change in quantity of received light in the photo detecting element when the ink droplet has been transmitted through the beam.

Since the detection mechanism of the second mode does not require a scanner moving time and an image reading time which are necessary in the detection mechanism of the first mode, it can detect the ejection defect at a higher speed. The conventional image recording apparatus of the second mode is constituted as shown in FIG. 13A, for example.

In FIG. 13, the image recording apparatus 110 has a recording head 120, a carriage 130 which supports the recording head 120, transferring means 140 for transferring a recording medium P in the sub scan direction, and driving means 150 for driving the carriage 130 in the main scan direction. In addition, the image recording apparatus 110 also has the above-described detection mechanism 160. The recording head 120 has a plurality of nozzles 121 which are arranged so as to face the recording medium P during image recording. The nozzles 121 are ink ejection openings.

The detection mechanism 160 is arranged outside of an image recording area in which an image is recorded in the main scan direction. In other words, the detection mechanism 160 is arranged in an inspection area which is an area other than the image recording area. The inspection area is an area used for detecting an ejection defect of the recording head. The detection mechanism 160 has an ink reservoir 161, a light source 162 and a photo detector 163. The ink reservoir 161 receives the ink ejected in the inspection area. Therefore, the ink reservoir 161 prevents the inside of the apparatus from being stained by the ejected ink when detecting an ejection defect.

The light source 162 is arranged along the arrangement direction of the nozzles 121 of the recording head 120 which has moved in the inspection area so as to be capable of emitting a beam. In other words, the detection mechanism 160 has an optical axis along the arrangement direction of the nozzles. The beam is schematically pointed by reference character B in FIG. 13B.

The photo detector 163 has a photo detecting element and is arranged so as to be capable of receiving the beam B from the light source 162.

The image recording apparatus 110 having the detection mechanism 160 detects an ejection defect as follows. The recording head 120 is first moved into the inspection area upon movement of the carriage 130 due to drive by the driving means 150. It is to be noted that the recording head 120 is moved in such a manner that the nozzles 121 are arranged on the optical axis of the beam B in the main scan direction as shown in FIG. 13C. That is, each nozzle 121 is arranged at a position intersecting the optical axis.

The recording head 120 causes the respective nozzles 121 from the nozzle 121 on one end side of the recording head to the nozzle 121 on the other end side of the same to sequentially eject the ink in the inspection area. At this moment, the ejected ink droplets are sequentially transmitted through the beam B and spotted in the ink reservoir 161. Since a quantity of received light varies when the ink droplet passes through the beam B, the photo detector 163 can detect passage of the ink droplet.

However, the detection mechanism 160 must match the optical axis of the beam B with the arrangement direction of the nozzles 121 in order to detect an ejection defect. Therefore, movement of the recording head 120 must be highly accurately controlled. Therefore, the detection mechanism 160 and the driving means 150 disadvantageously become complicated mechanisms. In addition, the image recording apparatus 110 performs inspection while carriage of the recording head 120 is stopped. Therefore, the entire image recording time including the inspection time of the image recording apparatus 110 is increased. That is, a recording speed of an image including the inspection time in the image recording apparatus 110 is lowered.

In the image recording apparatus including the detection mechanism, various proposals are provided in order to overcome the above-described problems. For example, in the image recording apparatus disclosed in Jpn. Pat. Appln. KOKAI Publication No. 179884/1999, the optical axis of the detection mechanism is set in a direction crossing the arrangement direction of the nozzles. Therefore, with the detection mechanism 160' being fixed, the beam B is caused to cross the flying path of the ink of the respective nozzles sequentially by moving the carriage as shown in FIG. 14A. Therefore, all the nozzles 121 can be assuredly caused to cross the optical axis of the beam B, thereby enabling detection of an ejection state.

Incidentally, since the photo detector 163 detects an ejection state based on a quantity of light when receiving the beam B, the ejection state of each nozzle can not be correctly detected if a plurality of the ink droplets have passed through the beam B at the same time. Therefore, in the image recording apparatus disclosed in Jpn. Pat. Appln. KOKAI Publication No. 179884/1999, the detection mechanism 160' has an angle of the optical axis adjusted with respect to the arrangement direction of the nozzle column as shown in FIG. 14B. Specifically, when including a plurality of nozzle columns, the light source 162 have an angle of the optical axis adjusted with respect to the arrangement direction of the nozzle columns in such a manner that the ink flying paths of a plurality of the nozzles do not cross the beam B at the same time. More specifically, an angle θ of the optical axis relative to the arrangement direction of the nozzle columns must have the relationship of the follow expression 1:

$$l \times \tan\theta < w \qquad \text{(Expression 1)}$$

w: gap between nozzle columns N1 and N2 adjacent to each other l: length of the nozzle columns N1 and N2

In general, when the gap w is increased, a width of the entire image recording apparatus becomes large. Therefore, the smaller gap w is good. Based on this restriction, the angle θ is generally selected to be a value smaller than 45 degrees.

Description will now be given as to the case where the recording head is moved for one cycle of the ink ejection cycle at a moving speed in image recording when the optical head crosses the nozzle 121_1 at the end of the recording head in the image recording apparatus with reference to FIG. 14C.

It is to be noted that the recording head 120 moves for the same distance as the interval of the nozzles when the recording head is moved in one cycle of the ink ejection cycle at the moving speed in image recording as described above. Therefore, when the recording head 120 is moved for a time corresponding to the one cycle, it moves for the same distance as the interval of the nozzles along the main scan direction. In FIG. 14, the recording head 120 after movement is indicated by a broken line. Therefore, when the angle θ is set smaller than 45 degrees, the nozzle 121_2 of the recording head 120 after movement moves beyond the beam B in the main scan direction. Therefore, the image recording apparatus must lower the moving speed of the recording head below the moving speed in image recording in order to detect the ejection state of all the nozzles 121. Accordingly, the image recording apparatus disclosed in Jpn. Pat. Appln. KOKAI Publication No. 179884/1999 requires a complicated mechanism in order to slow the speed of the recording head, and the image recording speed including the inspection time is decreased.

In the image recording apparatus including the detection mechanism, the image recording apparatus disclosed in Jpn. Pat. Appln. KOKAI Publication No. 188853/1999 is proposed in order to overcome the above-described problems. In the image recording apparatus disclosed in Jpn. Pat. Appln. KOKAI Publication No. 188853/1999, the optical axis of the detection mechanism is set in a direction crossing the arrangement direction of the nozzles as similar to the image recording apparatus disclosed in Jpn. Pat. Appln. KOKAI Publication No. 179884/1999. Additionally, the angle θ of the optical axis of the detection mechanism with respect to the nozzle arrangement direction also has the relationship similar to that shown in the expression 1. However, in the image recording apparatus disclosed in Jpn. Pat. Appln. KOKAI Publication No. 188853/1999, when the recording head is moved for a time corresponding to one cycle of the ink ejection cycle, the angle of the optical axis is adjusted in such a manner that, after at least one nozzle 121 has passed through the optical axis of the detection mechanism, another nozzle 121 different from the nozzle having passed through the optical axis is arranged on the optical axis. More specifically, as shown in FIG. 15, the nozzle 121_1 indicated by a solid line is placed at a position crossing the optical axis before movement of the recording head 120. The recording head 120 is moved for a time corresponding to one cycle of the ink ejection cycle. After this movement, as indicated by a broken line, the nozzles 121_2 and 121_3 move in the main scan direction beyond the beam B. However, the nozzle 121_4 indicated by the broken line is arranged on the optical axis. In this manner, the image recording apparatus disclosed in Jpn. Pat. Appln. KOKAI Publication No. 188853/1999 can detect the ejection state of the nozzles even if the carriage is moved at the moving speed in the regular image recording mode.

However, as described above, the image recording apparatus disclosed in Jpn. Pat. Appln. KOKAI Publication No. 188853/1999 skips at least one nozzle every cycle of the ink ejection cycle and detects the ejection state of the next nozzle. Therefore, the recording head must be scanned for a plurality of number of times in order to inspect all the nozzles. Accordingly, in this image recording apparatus, the speed for recording an image including the inspection time is still slow.

Further, in recent years, improvement of the image quality is demanded in the image recording apparatus, and elongation of the recording head or minimization of the interval of the nozzles is advanced. In this case, in the image recording apparatus disclosed in Jpn. Pat. Appln. KOKAI Publication No. 188853/1999, the above-described angle θ must be further reduced. Therefore, in this image recording apparatus, the recording speed must be further slowed, or the number of times of scanning the recording head must be increased. Thus, arrangement of the optical axis in the detection mechanism must be highly accurately adjusted, and hence manufacture may become difficult.

In view of the above-described problems, there is desired an image recording apparatus having a detection mechanism which can detect an ejection state of each nozzle at a high speed and does not require sophisticated positional adjustment of the optical axis of the detection mechanism and the nozzles.

BRIEF SUMMARY OF THE INVENTION

To solve the above-described problems and achieve this object, and image recording apparatus according to the present invention is configured as follows.

According to one aspect of the present invention, there is provided an ink jet recording apparatus comprising:

an ink jet recording head which includes a plurality of nozzles divided into a plurality of groups and ejects an ink from a plurality of the nozzles;

a carriage on which the ink jet recording head is mounted and which is driven to reciprocate in a direction orthogonal to a transferring direction of a recording medium;

a sensor which is provided in a drive range of the carriage and provided in such a manner that an optical axis of its detection light is inclined with respect to a movement direction of the carriage, and optically detects an ink ejected from each of a plurality of the nozzles of the ink jet recording head; and a controller which controls an ink ejection operation of the ink jet recording head, inspects an ink ejection state from a plurality of the nozzles based on an output result from the sensor, and shifts an ink ejection timing every group when inspecting the ink ejection state of the ink jet recording head, the shifting time being shorter than an ejection cycle in image recording of each group.

Furthermore, according to another aspect of the present invention, there is provided an ink jet recording apparatus comprising:

a plurality of ink jet recording head each of which includes a substantially linear nozzle column consisting of a plurality of nozzles;

a carriage on which a plurality of the ink jet recording heads are mounted in such a manner that each of a plurality of the ink jet recording heads is arranged along a direction orthogonal to a recording medium transferring direction and its nozzle column is arranged along the transferring direction of the recording medium, and which is driven in a direction orthogonal to the transferring direction of the recording medium;

a sensor which is provided in a drive range of the carriage and provided in such a manner that an angle of its detection light is inclined at an angle crossing a plurality of the nozzle columns, and optically detects an ink ejected from a plurality of the nozzle columns; and a controller which controls an ink ejection operation of a plurality of the ink jet recording heads, inspects the ink ejection state from a plurality of the nozzles based on an output result from the sensor, and shifts an ink ejection timing every plural nozzle columns when inspecting the ink ejection state, the shifting time being shorter than an ejection cycle in image recording of each nozzle column.

Moreover, according to still another aspect of the present invention, there is provided an ink jet recording apparatus comprising:

an ink jet recording head which includes a substantially linear nozzle column consisting of a plurality of nozzles divided into a plurality of groups;

a sensor which is arranged in such a manner that its detection light is inclined at an angle crossing the nozzle column, and detects passage of the ink when the ink ejected from each nozzle in the nozzle arrangement comes across the detection light; and a controller which controls an ink ejection operation of the ink jet recording head, relatively moves the ink jet recording head and the sensor, inspects the ink ejection state by passing the ink ejected from all the nozzles constituting the nozzle column through the detection light, and shifts an ink ejection timing every group when inspecting the ink ejection timing, the shifting time being shorter than an ejection cycle in image recording of each group.

Advantages of the invention will be set forth in the description which follows, and in part will be obvious from the description, or may be learned by practice of the invention. Advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Preferred embodiments according to the present invention will now be described hereinafter with reference to the accompanying drawings.

Figure 1A:
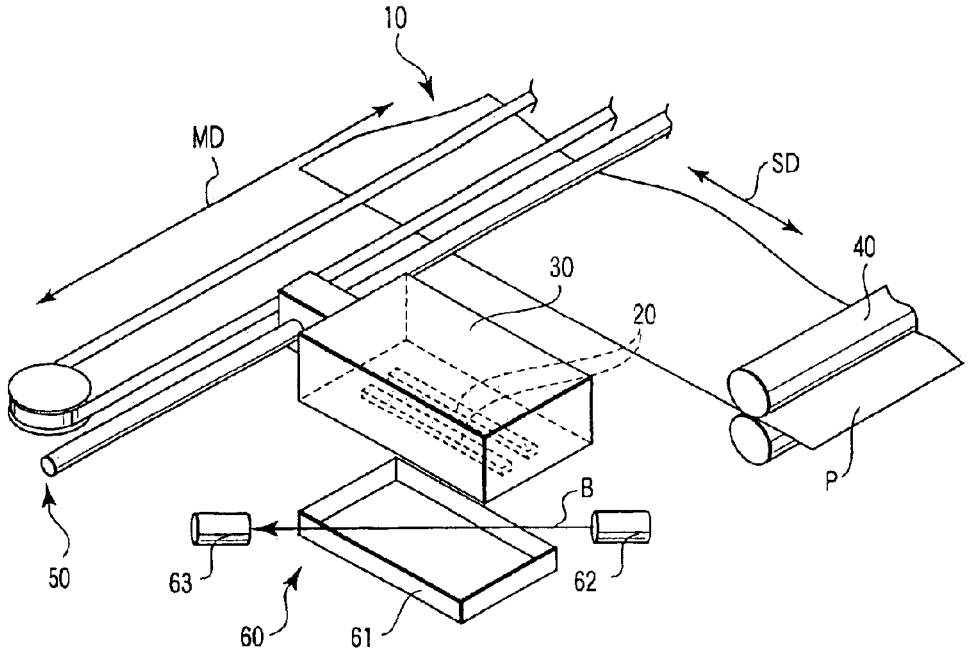
FIG. 1A is a perspective view showing a part of an image recording apparatus according to a first embodiment.

An image recording apparatus according to a first embodiment will be first explained in connection with FIG. 1A. FIG. 1A is a perspective view showing a part of an image recording apparatus 10 according to the embodiment.

The image recording apparatus 10 has two recording heads 20, a carriage 30, a transfer mechanism 40, a driving mechanism 50, a detection mechanism 60, a sensor portion 70, and a controller 80.

Figure 1B:
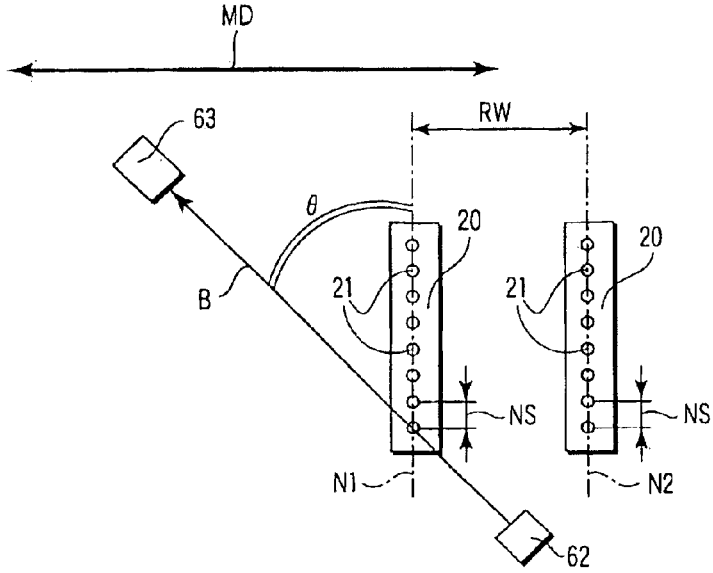
FIG. 1B is a schematic top view showing a recording head illustrated in FIG. 1A.

The two recording heads 20 are attached to the carriage 30 in such a manner that a longitudinal direction of itself coincides with a sub scan direction which is a transferring direction of a recording medium P. In addition, the two recording heads 20 are arranged so as to be distanced from each other by approximately 175 μm along a main scan direction orthogonal to the sub scan direction. Additionally, each recording head 20 has a plurality of nozzles 21 which are ejection openings of an ink as shown in FIG. 1B. It is to be noted that the recording head 20 is disposed to the carriage 30 in such a manner that the nozzles 21 face the recording medium P. A plurality of the nozzles 21 are arranged along the longitudinal direction of the recording head 20. In other words, nozzle columns N1 and N2 which are columns of the nozzles 21 extend along the sub scan direction. Additionally, a column gap RW between the nozzle columns N1 and N2 is set to approximately 175 μm. The respective nozzles 21 are arranged at predetermined intervals NS along the longitudinal direction of the recording head.

It is to be noted that the recording capability of each recording head 20 is set to 360 dpi in this embodiment. Therefore, the interval NS of the nozzles 21 is approximately 70 μm.

Further, the recording head 20 has ejection force applying means for ejecting an ink every nozzle 21. The ejection force applying means is, for example, a piezoelectric element. The ejection force applying means intermittently ejects the ink in a predetermined cycle. The ink ejection cycle of this ejection force applying means is determined based on the essential capability of the recording heads. Therefore, the ejection cycle can not be accelerated beyond this capability. The ejection force applying means according to this embodiment has an ejection frequency set to 10 kHz. In other words, the ejection force applying means has an ink ejection cycle T set to 100 μsec. Furthermore, the ejection force applying means has an ink flying speed Vf which is set in such a manner that the ink can be ejected at approximately 5 m/sec.

The carriage 30 is attached to the driving mechanism 50 and can move along the main scan direction. The driving mechanism 50 drives the carriage 30 along the main scan direction. The transfer mechanism 40 transfers the recording medium P along the sub scan direction. It is to be noted that the carriage 30 is driven at a constant speed in an image recording area in which an image is recorded on a recording medium. Therefore, the image recording area is a constant speed drive area of the carriage.

It is to be noted that the recording heads 20, the transfer mechanism 40 and the driving mechanism 50 are respectively connected to the controller 80 and their drive is controlled by the controller 80.

The detection mechanism 60 is arranged outside the image recording area of the recording heads 20. In other words, the detection mechanism 60 is arranged at a position where it does not face the recording medium in a movable area of the recording heads 20 along the main scan direction. In this specification, a set position of the detection mechanism 60 is referred to as an inspection area. This inspection area is an area in which the detection mechanism 60 detects an ejection defect. It is to be noted that the carriage 30 reverses the movement direction in the main scan direction outside the image recording area. Therefore, it can be the that the inspection area is a reversing drive area in which the carriage 30 is operated to be reversed.

The detection mechanism 60 has an ink reservoir 61, a light source 62 and a photo detector 63. The ink reservoir 61 receives the ink ejected in the inspection area. Therefore, the ink reservoir 61 prevents the inside of the apparatus from being stained by the ejected ink when detecting the ejection defect.

The light source 62 is, for example, a semiconductor laser. This light source 62 is arranged in such a manner that a beam B can be emitted in a direction crossing the arrangement direction of the nozzle columns N1 and N2 of the recording heads 20 moved into the inspection area. More specifically, as shown in FIG. 1B, an angle θ formed by the arrangement direction of the nozzle columns N1 and N2 and the beam B is set to approximately 45 degrees.

A width BW of the beam B (see FIG. 3) is set to approximately 140 μm. The light source 62 is arranged in such a manner that the beam B can pass a position distanced from the nozzles 21 by approximately 1 mm in the ink ejection direction. In other words, a gap between each nozzle 21 and the outer edge of the beam B in the ink ejection direction (nozzle/beam gap H) is approximately 1 mm.

The photo detector 63 has a photo detecting element and is arranged so as to be capable of receiving the beam B from the light source 62. That is, the photo detector 63 is arranged on the optical path of the beam B. The photo detector 63 is a sensor which detects a change in quantity of light which has entered the photo detecting element. The photo detector 63 is connected to the controller 80, and outputs a detection result to the controller 80.

Although not shown, the sensor portion 70 has a sensor such as a linear encoder, which detects a position of the carriage 30 along the main scan direction. The sensor portion 70 is connected to the controller 80 and transmits a detection result to the controller 80.

Figure 2:
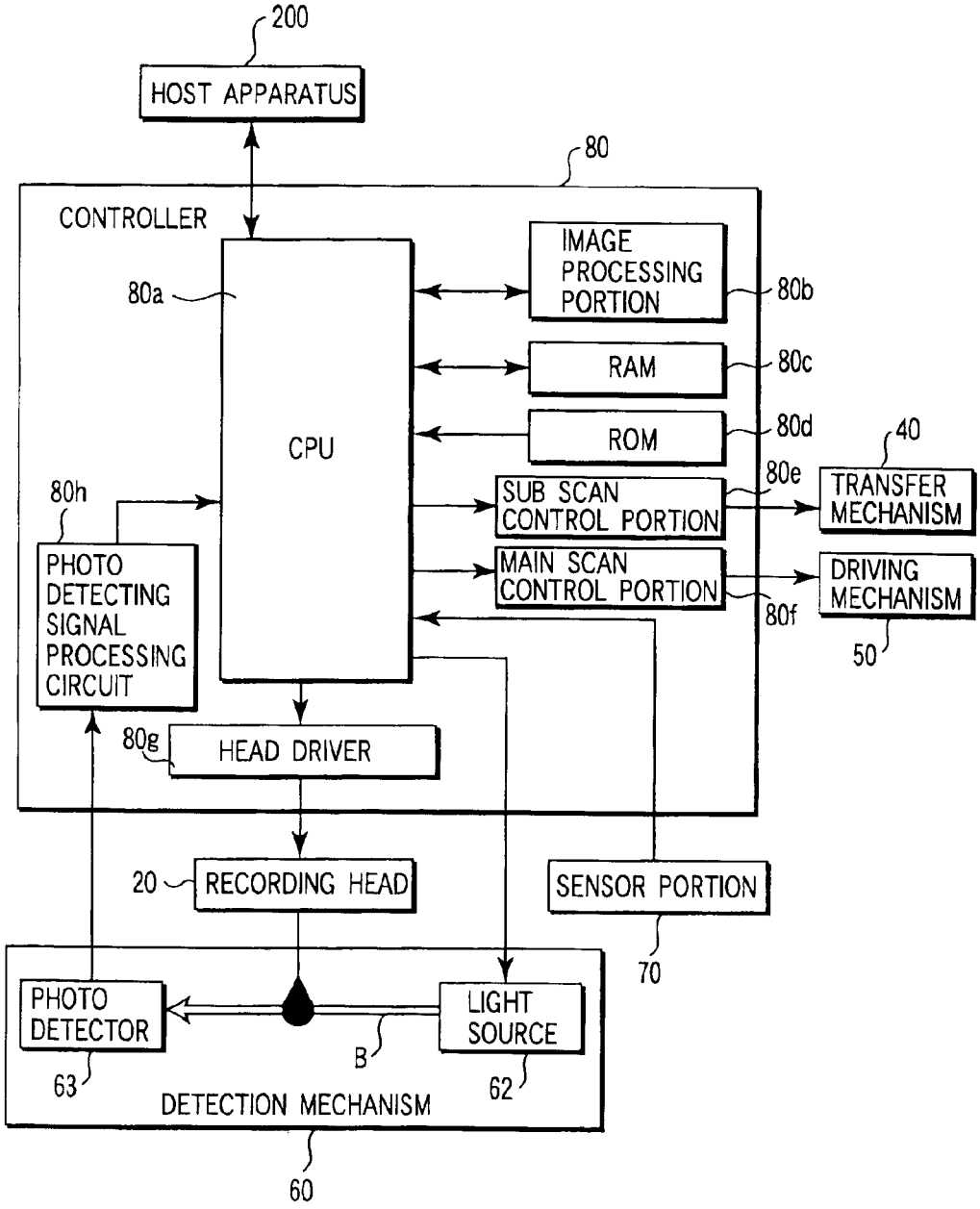
FIG. 2 is a schematic view showing a controller according to the first embodiment.

The controller 80 controls drive of the image recording apparatus 10. This controller 80 has a CPU 80*a*, an image processing portion 80*b*, an RAM 80*c*, a ROM 80*d*, a sub scan control portion 80*e*, a main scan control portion 80*f*, a photo detecting signal processing circuit 80*h* and a head driver 80*g*, as shown in FIG. 2.

The CPU 80*a* receives image data transferred from a host apparatus 200, or image data read from the ROM 80*d*. Furthermore, the CPU 80*a* executes various arithmetic operation processing. Moreover, the CPU 80*a* provides the image data to the image processing portion 80*b*. In addition, the CPU 80*a* makes reference to control information in the ROM 80*d*, and issues a command to control the image recording apparatus 10.

The image processing portion 80*b* converts the image data transmitted from the CPU 80*a* into a control signal for image recording.

The RAM 80*c* is used as a work area when the CPU 80*a* executes various operations, and temporarily stores therein the image data transferred from the host apparatus 200.

The ROM 80*d* stores therein the image data such as a predetermined test pattern or the control information required for controlling the image recording apparatus 10.

The sub scan control portion 80*e* is connected to the CPU 80*a* and the transfer mechanism 40, and controls drive of the transfer mechanism 40 in response to a command from the CPU 80*a*.

The main scan control portion 80*f* is connected to the CPU 80*a* and the driving mechanism 50, and controls drive of the driving mechanism 50 in response to a command from the CPU 80*a*.

The head driver 80*g* is connected to the CPU 80*a* and the recording head 20, and controls an ink ejection timing of the recording heads 20 in response to a command from the CPU 80*a*.

The photo detecting signal processing circuit 80*h* is connected to the CPU 80*a* and the photo detector 63, receives an output signal from the photo detector 63, performs digital conversion of the output signal, and supplies an obtained result to the CPU 80.

The operation of the image recording apparatus 10 having the above-described structure will now be described.

In recording of an image, the CPU 80*a* first receives image data of an image as a recording target from the host apparatus 200 or the ROM 80*d*. It is to be noted that the image data is temporarily stored in the RAM 80*c*. The CPU 80*a* transmits the image data in the RAM 80*c* to the image processing portion 80*b*. The image processing portion 80*b* outputs to the CPU 80*a* a signal for controlling drive of the transfer mechanism 40, the driving mechanism 50 and the recording heads 20 based on the image data.

The CPU 80*a* supplies this signal to the sub scan control portion 80*e*, the main scan control portion 80*f* and the head driver 80*g*. As a result, the sub scan control portion 80*e* controls the transfer mechanism 40, the main scan control portion 80*f* controls the driving mechanism 50, and the head driver 80*g* controls the recording heads 20.

Based on this control, the driving mechanism 50 moves the recording heads 20 at a predetermined moving speed along the main scan direction. With this movement, the recording heads 20 eject the ink in a predetermined ejection cycle. As a result, the image recording apparatus 10 records an image on the recording medium P.

It is to be noted that the moving speed of the recording heads 20 is set so as to move for a distance corresponding to the interval NS of the nozzles 21 in one cycle of the ink ejection cycle. Therefore, the recording heads 20 can record ink dots D in even arrangement as described above in connection with the prior art. In this case, the moving speed Vk of the recording heads 20 can be obtained by the following expression 2:

$$Vk=NS/T \quad \text{(Expression 2)}$$

T: ink ejection cycle

NS: interval between the adjacent nozzles in the nozzle arrangement direction

Since the interval NS is approximately 70 $\mu$n and the ink ejection cycle T is 100 $\mu$sec, the moving speed Vk of the recording heads 20 is approximately 0.7 m/sec based on the expression 2.

The recording heads 20 record an image along the main scan direction based on movement along the main scan direction. With this recording, recording of the image for a length of the nozzle columns N1 and N2 of the recording heads 20 along the sub scan direction is completed for one row along the main scan direction. The controller 80 operates the transfer mechanism 40 so as to transfer the recording medium P along the sub scan direction upon completion of recording of each one row. The image recording apparatus 10 sequentially records the image formed in rows by the above-described operation, and completes recording of the entire image on the recording medium P.

The image recording apparatus 10 inspects the ink ejection state of each nozzle 21 before start of image recording, during the image recording operation and/or after termination of image recording. The inspection is executed when the recording heads 20 has moved into the inspection area.

Figure 3:
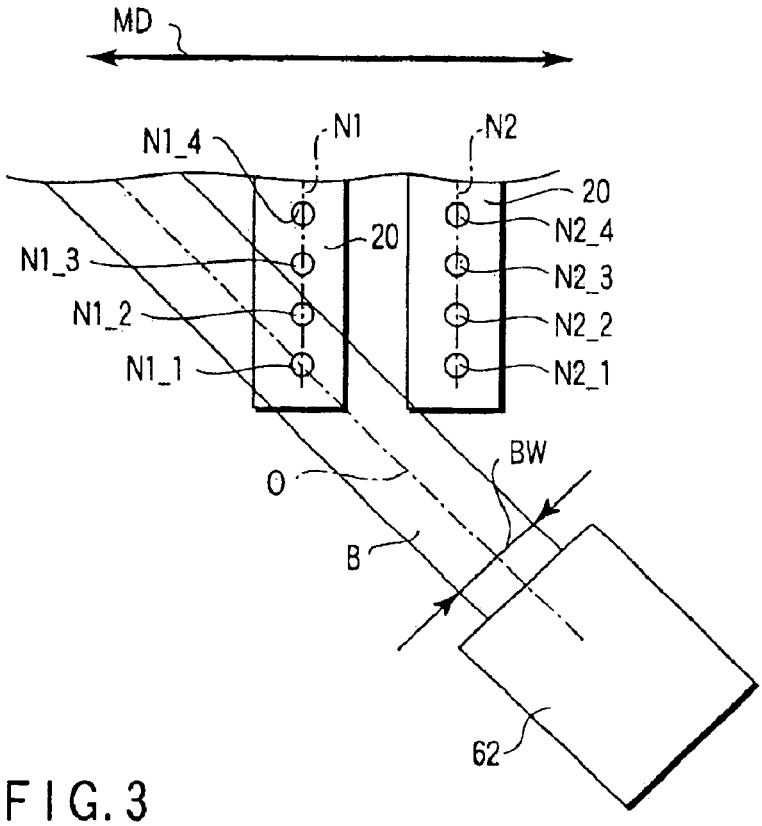
FIG. 3 is a schematic top view showing the relationship between a nozzle column and a beam.

The operation of the image recording apparatus 10 in the ejection state inspection will now be described with reference to FIG. 3. It is to be noted that the respective nozzles 21 in the nozzle column N1 are denoted by reference numerals N1_1, N1_2, . . . from the light source 62 side in sequence in the arrangement direction of the nozzle column N1 in FIG. 3. Similarly, the nozzles 21 in the nozzle column N2 are designated by reference numerals N2_1, N2_2, . . . from the light source 62 side in sequence. The nozzle column N1 is determined as a first nozzle group, and the nozzle column N2 is determined as a second nozzle group.

The ejection state inspection is carried out by transmitting the ink droplets ejected from the nozzles 21 through the beam B. The ejection state inspection is carried out during movement of the recording heads 20. The moving speed of the recording heads 20 during this inspection is the same as the moving speed in image recording.

In the inspection, when the recording heads 20 are moved to the inspection area, the nozzle 21 which first crosses the beam B is inspected first. Therefore, the controller 80 controls an ink ejection timing of the recording head 20 in such a manner that the ink droplet ejected from the nozzle 21 as a first inspection target can be transmitted through the beam B. It is to be noted that the nozzle 21 as the first inspection target is the nozzle N1_1. The above-described control is executed as follows.

At first, the sensor portion 70 occasionally transmits positional information of the carriage 30 (position along the main scan direction) to the CPU 80*a*. It is to be noted that the recording heads 20 are positioned to the carriage 30 and fixed to the carriage 30. Therefore, the CPU 80*a* can obtain the positions of the recording heads 20 based on the positional information.

During inspection of the ink ejection state, the recording heads 20 eject the ink during movement. It is to be noted that the image recording apparatus 10 moves the recording heads 20 in this inspection at the same moving speed as that in image recording. Based on this, the beam B and the nozzle 21 are distanced from each other by a nozzle/beam distance H in the ink ejection direction. Therefore, the recording head 20 ejects the ink from a position separated from the nozzle N1_1 by a distance Di on the opposite side to the moving direction of itself so as to transmit the ejected ink droplet through the beam B.

In order to obtain the distance Di, a time Ta required for the ink to reach the beam B is first calculated from the following expression 3:

$$Ta=H/Vf \quad \text{(Expression 3)}$$

H: nozzle/beam distance

Vf: ink flying speed

As described in connection with the structure, the nozzle/beam distance H is approximately 1 mm, and the ink flying speed Vf is approximately 5 m/sec. Therefore, the time Ta required for the ink to reach the beam B is approximately 200 μsec based on the expression 3.

The distance Di is a distance that the recording head 20 moves from the nozzle N1_1 in the time Ta. Thus, the distance Di can be obtained from the following expression 4:

$$Di=Ta\times Vk \quad \text{(Expression 4)}$$

Vk: moving speed of the recording head 20

As described above in connection with the structure, the moving speed of the recording head 20 is approximately 0.7 m/sec. At this moment, the distance Di is 140 μm based on the expression 4. It is to be noted that the distance Di is stored in the ROM 80*d*.

Figure 5:
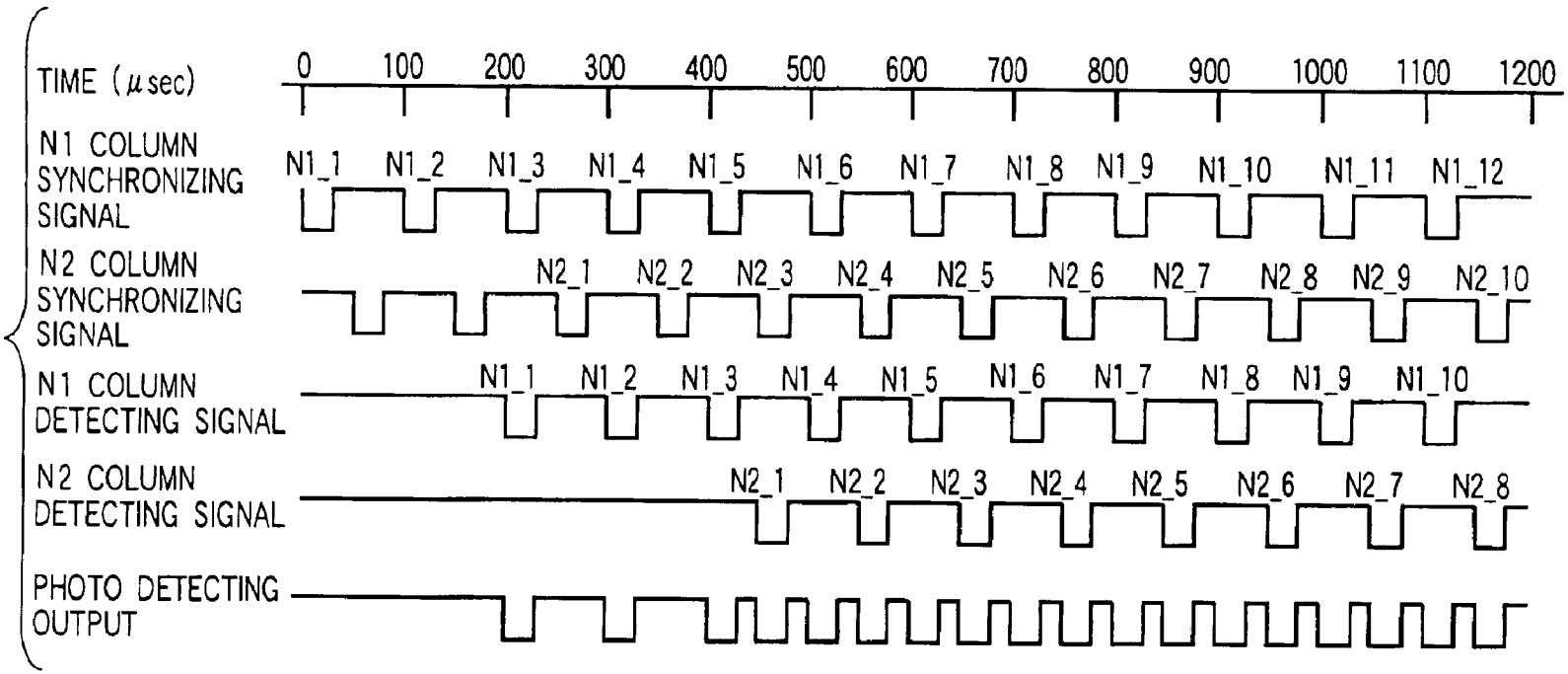
FIG. 5 is a view showing each of a synchronizing signal, a detecting signal and a photo detecting output of the image recording apparatus according to the first embodiment.

The CPU 80*a* outputs an N1 column synchronizing signal to the head driver 80*g* when the position of the recording head 20 transmitted from the sensor portion 70 matches with the position separated from the nozzle N1_1 by the distance Di. The N1 column synchronizing signal is a cycle similar to the ink ejection cycle in image recording. The head driver 80*g* operates the recording head 20 in such a manner that the respective nozzles 21 in the nozzle column N1 eject the ink in the order from the nozzle N1_1 along the arrangement direction of the nozzles in accordance with the N1 column synchronizing signal. In other words, the N1 column synchronizing signal determines the nozzle ejection cycle of the first nozzle group. FIG. 5 shows the N1 column synchronizing signal.

With this operation, the ink droplet ejected from the nozzle N1_1 is transmitted through the beam B and spotted in the ink reservoir 61. Moreover, the ink droplet ejected from the nozzles 21 other than the nozzle N1_1 are also spotted in the ink reservoir 61. Therefore, the inside of the image recording apparatus 10 is prevented from being stained by the ink droplet ejected during the ejection state inspection.

Figure 4A:
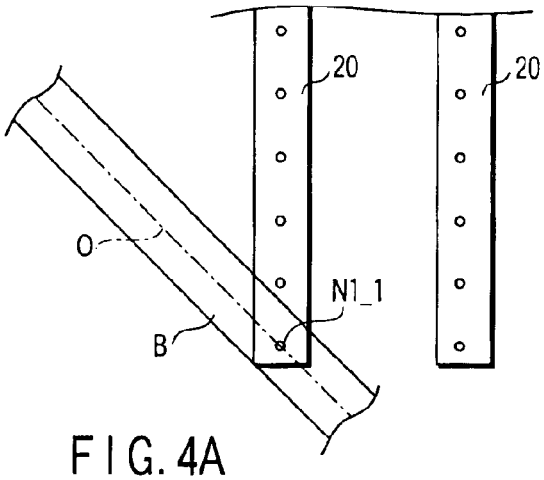
FIG. 4A is a schematic top view showing the relationship between the nozzle column and the beam.

There is a light source 62 such that a light intensity distribution of the beam B increases as it gets closer to the optical source. In this case, as shown in FIG. 4A, it is desirable that the ink flying path from the nozzle N1_1 passes the vicinity of the optical axis O of the beam B. In detail, when the ink droplet is ejected so as to pass the vicinity of the optical axis O, the S/N ratio in the photo detector 63 is increased.

In this manner, when the ink droplet passes through the beam B, a quantity of light received by the photo detector 63 varies. Further, the photo detector 63 transmits a change in voltage to the photo detecting signal processing circuit 80*h*.

It is to be noted that a difference in light intensity in the beam is small when the beam B is formed into a slit shape. In this case, when the ink droplet passes through at least one part of the beam B, the photo detector 63 can detect a change in quantity of light.

It is to be noted that the nozzle N1_1 ejects the ink droplet in such a manner that the ink droplet passes the vicinity of the optical axis O.

After one cycle of the ink ejection cycle T from ejection of the ink by the nozzle N1_1, specifically, after 100 μsec, the nozzle N1_2 ejects the ink. It is to be noted that the recording head 20 constantly moves in the main scan direction during the inspection at the moving speed similar to that in image recording as described above. That is, the recording head 20 moves in the main scan direction from the position, at which the nozzle N1_1 has ejected the ink, for a distance Dk obtained by the following expression 5 after one cycle:

$$Dk=Vk\times T \quad \text{(Expression 5)}$$

The moving speed Vk is approximately 0.7 m/sec. At this moment, the distance Dk is approximately 70 μm based on the expression 5.

It is to be noted that the nozzle N1_2 is shifted from the nozzle N1_1 at the nozzle interval NS in the nozzle arrangement direction. That is, the flying path of the ink droplet ejected from the nozzle N1_1 is shifted from the flying path of the ink droplet ejected from the nozzle N1_2 at the nozzle interval NS in the nozzle arrangement direction. In this case, in order to detect the ink droplet ejected from the nozzle N1_2 by the detection mechanism 60, the beam B must cross the flying path of the ink droplet from the nozzle N1_2. Furthermore, in order to detect all the nozzles 21 by the detection mechanism 60, the flying paths of the ink droplets ejected from the nozzles adjacent to each other must cross the beam B in each of the nozzle columns N1 and N2.

It is to be noted that the moving direction of the recording head 20 is only the main scan direction. Therefore, in order to cause the beam B to cross the flying path of the ink droplet as described above, the beam B and the recording head 20 must be inclined with respect to the nozzle arrangement direction at an angle θ. It is to be noted that the angle θ has the relationship of the following expression 6:

$$\theta\approx\arctan(Dk/NS) \quad \text{(Expression 6)}$$

NS: distance between nozzles adjacent to each other in the nozzle arrangement direction When the beam B is inclined in this manner, the relative position between the beam B and the recording head 20 in the nozzle arrangement direction is moved for a predetermined distance by movement in the main scan direction in one cycle mentioned above. In this embodiment, the nozzle interval NS is 70 μm and the distance Dk is 70 μm. Furthermore, the angle θ is approximately 45 degrees.

The ink droplet ejected from the nozzle N1_2 can pass through the beam B by inclination of the beam B. Therefore, the detection mechanism 60 can detect the ink droplet from the nozzle N1-2 after detecting the ink droplet from the nozzle N1_1.

It is to be noted that the ejected ink droplet can pass through the beam B even if the angle θ deviates from a value obtained based on arctan (Dk/NS) to some degree since the beam B has a width BW.

The CPU 80*a* outputs an N1 synchronizing signal and an N2 column synchronizing signal which determines the ink ejection cycle of the nozzle column N2 at the same time. The N2 column synchronizing signal determines the nozzle ejection cycle of the second nozzle group.

In the image recording apparatus 10, the recording heads 20 constantly move at the moving speed Vk mentioned above. Therefore, before completing inspection of all the nozzles 21 in the nozzle column N1, the nozzles 21 in the nozzle column N2 move to ejection positions. In other words, before completing inspection of all the nozzles 21 in the nozzle column N1, the flying path of the ink ejected from the nozzles 21 in the nozzle column N2 crosses the beam B.

The ink droplets ejected from the respective nozzles 21 in the nozzle column N1 pass the vicinity of the optical axis O. Similarly, in order to cause the ink droplets ejected from the respective nozzles 21 in the nozzle column N2 to pass the vicinity of the optical axis O, the nozzles 21 in the nozzle column N2 eject the ink from the positions in the main scan direction which are the same as the ejection positions of the nozzles 21 in the nozzle column N1 in the nozzle arrangement direction. As a concrete example, when the nozzle N2_1 ejects the ink from the position equal to the ink ejection position of the nozzle N1_1, the ink flying path from the nozzle N2_1 is substantially the same as the ink flying path from the nozzle N1_1.

It is to be noted that the nozzle columns N1 and N2 are separated from each other by the gap RW in the main scan direction.

In the above case, a time Tm required for the recording head 20 to move to the ink ejection position of the nozzle N2_1 after ejection of the ink from the nozzle N1_1 can be obtained based on the following expression 7:

$$Tm=RW/Vk \quad \text{(Expression 7)}$$

RW: gap between the nozzle columns N1 and N2 (column gap)

Vk: moving speed of the recording head

When the column gap RW is approximately 175 μm and is the moving speed Vk is approximately 0.7 m/sec, the time Tm is approximately 250 μsec based on the expression 7. It is to be noted that the ink ejection cycle T is 100 μsec. Therefore, it is preferable for the nozzle N2_1 to eject the ink between the third ink ejecting nozzle N1_3 and the fourth ink ejecting nozzle N1_4 in the nozzle column N1.

Moreover, in order to correctly inspect the ejection state of the nozzles, the number of the ink droplet which passes through the beam B at a time must be one.

Therefore, the N2 column synchronizing signal and the N1 column synchronizing signal have the same cycle, but their ejection timings are shifted from each other. Specifically, the timing of the N2 column synchronizing signal is shifted from that of the N1 column synchronizing signal in such a manner that the ink droplet ejected from each nozzle 21 in the nozzle column N1 and the ink droplet ejected from the nozzle column N2 do not exist in the beam B at the same time. As a result, each nozzle in the nozzle column N2 ejects the ink droplet in a period from completion of passage of the ink droplet ejected from one of the adjacent nozzles in the nozzle column N1 through the beam B to entering of the ink droplet ejected from the other nozzle into the beam B. As a further concrete example, in a period from completion of passage of the ink droplet ejected from the nozzle N1_3 in the nozzle column N1 to entering of the ink droplet ejected from the nozzle N1_4 into the beam B, the nozzle N2_1 ejects the ink droplet. As a result, in the respective nozzles in the nozzle column N2, the ejection timing of one of the adjacent nozzles in the nozzle column N1 is shifted from the ejection timing of the other nozzle by a passage time required for the ink droplet to pass through the beam B. It is to be noted that the passage time Tt required for the ink droplet to pass through the beam B can be obtained based on the following expression 8:

$$Tt=BW/Vf \quad \text{(Expression 8)}$$

The ink flying speed Vf is set to approximately 5 m/sec and the width BW of the beam is set to 140 μm. In this case, based on the expression 8, the passage time Tt is approximately 28 μsec. As described above, when the N2 column synchronizing signal is shifted from the N1 column synchronizing signal by at least Tt, the ink droplet emitted from the nozzle in the nozzle column N1 and the ink droplet emitted from the nozzle in the nozzle column N2 are prevented from passing through the beam at the same time. It is to be noted that the time Tt varies in some degree depending on a cross-sectional shape of the beam B.

As described above, the N2 column synchronizing signal and the N1 column synchronizing signal are shifted from each other by the passage time Tt required for the ink droplet to pass through the beam B. That is, the N2 column synchronizing signal is shifted by a time Tz satisfying the relationship of the following expression 9 with respect to the N1 column synchronizing signal:

$$Tt<Tz<T-Tt \quad \text{(Expression 9)}$$

T: ejection cycle of the ink

It is to be noted that the ejection cycle T of the ink is 100 μsec in this embodiment. Therefore, the time Tz falls within a range of 28 μsec<time Tz<72 μsec.

It is to be noted that the time Tz is determined taking the desired ejection timing obtained from the expression 7 and the range of Tz based on the expression 9 into consideration. That is, the ejection timing of the ink droplet ejected from the nozzle 21 in the nozzle column N2 is selected in such a manner that the ink droplet can pass through the vicinity of the optical axis of the beam B without any other ink droplet also existing in the optical beam at the same time. In this embodiment, the time Tz is set to 50 μsec. The N2 column synchronizing signal is shown in FIG. 5. As shown in FIG. 5, the nozzle N2_2 ejects the ink when 50 μsec has elapsed after ejection of the ink from the nozzle N1_3. In other words, the nozzle N2_1 ejects the ink after 250 μsec from ejection of the ink by the nozzle N1_1. In this manner, since the ink is ejected after 50 μsec from ejection of the ink by the nozzle N1_3, the nozzle columns N1 and N2 alternately eject the ink droplets.

Figure 4B:
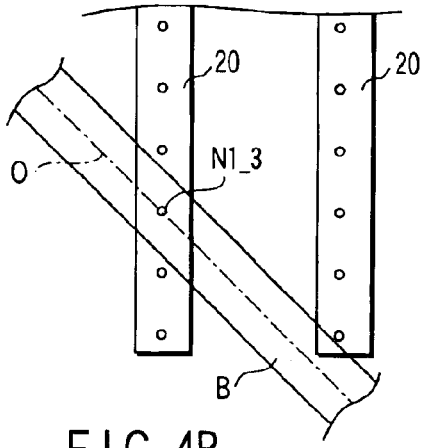
FIG. 4B is a schematic top view showing the relationship between the nozzle column and the beam.
Figure 4C:
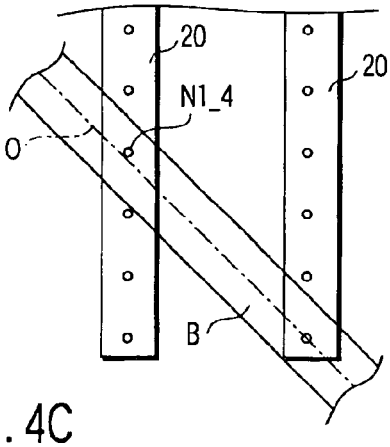
FIG. 4C is a schematic top view showing the relationship between the nozzle column and the beam.

The detection mechanism 60 detects the ink droplet ejected from the nozzle N2_1 at a position shown in FIG. 4C. It is to be noted that the ink droplet ejected from the nozzle N1_3 is detected at a position of the recording head 20 illustrated in FIG. 4B. In this manner, the ink droplet from the nozzle N2_1 can pass through the beam on its own. Therefore, the detection mechanism 60 can assuredly inspect the ejection state.

Figure 4D:
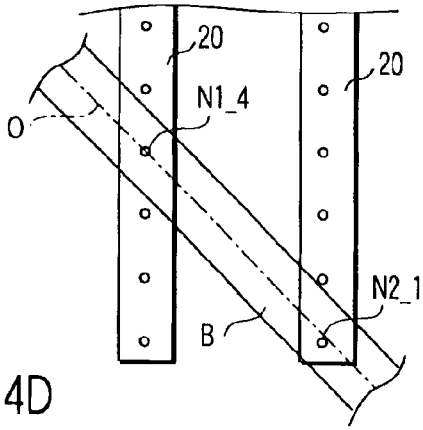
FIG. 4D is a schematic top view showing the relationship between the nozzle column and the beam.

After 50 μsec from ejection of the ink by the nozzle N2_1, the nozzle N1_4 ejects the ink. The detection mechanism 60 detects this ejected ink droplet at a position shown in FIG. 4D. As shown in FIG. 4D, the ink flying paths from the nozzle N1_4 and the nozzle N2_1 exist in the beam B. However, as described above, the ejection timing of the nozzle N1_4 is shifted from that of the nozzle N2_1. Therefore, the ink droplet from the nozzle N1_4 can pass through the beam on its own. Accordingly, the detection mechanism 60 can assuredly inspect the ejection state.

In this manner, the ink ejection timing of each nozzle 21 in the nozzle column N1 as the first nozzle group is shifted from that of each nozzle 21 in the nozzle column N2 as the second nozzle group. As a result, the ink droplet ejected from the first nozzle group does not interfere with that ejected from the second nozzle group. Thus, the detection mechanism 60 can inspect the ejection state of the nozzles in each group even if the ink flying paths of the both groups exist in the beam.

It is to be noted that the head driver 80*g* is operated so that the respective nozzles 21 in the nozzle column N2 can eject the ink in the order from the nozzle N2_1 along the nozzle arrangement direction in accordance with the N2 column synchronizing signal. Therefore, the nozzles in the nozzle column N1 and the nozzles in the nozzle column N2 can eject the ink with their ejection timings being constantly shifted from each other.

It is to be noted that the ejection timing of the nozzle N2_1 such as one obtained based on the expression 9 is stored in the ROM 80*d*.

When the ink droplet ejected from the nozzle N2_1 by the above-described operation passes through the beam B, a quantity of the light received by the photo detector 63 varies. In addition, the photo detector 63 transmits a change in voltage to the photo detecting signal processing circuit 80*h*.

As described in the above operation, in the image recording apparatus 10, the nozzle column N1 and the nozzle column N2 sequentially eject the ink in accordance with the N1 column synchronizing signal and the N2 column synchronizing signal, respectively. Additionally, the detection mechanism 60 sequentially transmits presence/absence of passage of the ink to the photo detecting signal processing circuit 80*h*.

The photo detecting signal processing circuit 80*h* stores a detection cycle in the ROM 80*d*. The photo detecting signal processing circuit 80*h* digitalizes a change in voltage based on this detection cycle. Further, the signal processing circuit 80*h* transmits this change in voltage to the CPU 80*a* as passage information indicative of presence/absence of passage of the ink droplet.

As the detection cycle, there are an N1 column detecting signal which is a detection cycle for detecting the ejection state of the nozzle column N1 and an N2 column detecting signal which is a detection cycle for detecting the ejection state of the nozzle column N2.

The N1 column detecting signal is stored in the ROM 80*d*. This N1 column detecting signal has the same cycle as that of the N1 column synchronizing signal, but it is outputted when the time Ta obtained from the expression 3 has elapsed after ejection of the ink by the nozzle N1_1. That is, the timing is shifted so that detection can be carried out when the ink droplet ejected from the nozzle column N1 has reached the beam. Furthermore, a period of the passage time Tt obtained by the expression 8 is set as a detection time of the photo detecting signal processing circuit 80*h*. The N1 column detecting signal is illustrated in FIG. 5.

Similarly, the N2 column detecting signal is stored in the ROM 80*d*. This N2 column detecting signal has the same cycle as that of the N2 column synchronizing signal, but it is outputted when the time Ta obtained by the expression 3 has elapsed after ejection of the ink by the nozzle N2_1. Moreover, a period of the passage time Tt obtained by the expression 8 is set as a detection time of the photo detecting signal processing circuit 80*h*. The N2 column detecting signal is illustrated in FIG. 5.

When the ink passes through the beam B in the period of detecting the N1 column detecting signal, a voltage supplied from the photo detector 63 to the photo detecting signal processing circuit 80*h* varies. The photo detecting signal processing circuit 80*h* supplies passage information indicative of passage of the ink to the CPU 80*a* when the voltage has varied. In addition, the photo detecting signal processing circuit 80*h* supplies passage information indicative of no passage of the ink to the CPU 80*a* when the ink did not pass in the detection period. The photo detecting signal processing circuit 80*h* also supplies the passage information to the CPU 80*a* in the period of detecting the N2 column detecting signal as similar to the above. Such passage information is shown in FIG. 5. It is to be noted that the photo detecting output in FIG. 5 is the one when the ink has all passed in the detection period of the N1 column detecting signal and the N2 column detecting signal.

It is to be noted that FIG. 4 shows the state that the flying path of the ink from the nozzle N1_1 matches with the optical axis O of the beam B.

The CPU 80*a* transmits the passage information to the RAM 80*c*, counts the number of ink passages, and records a result in the RAM 80*c*. It is to be noted that a total number of the nozzles is stored in the ROM 80*d*. The CPU 80*a* compares the number of ink passages relative to all the nozzles in all the nozzle columns with the total number of the nozzles which is a sum of all the nozzles in all the nozzle columns. Based on this comparison, it can be understood that there is an ejection defect of the nozzle when the total number of ink passages is smaller than the nozzle number. In this way, the controller 80 can inspect the ejection state of the nozzles.

As described in the above structure and operation, the beam B is inclined relative to the nozzle arrangement direction at the angle θ, and the timing of the N2 column synchronizing signal is shifted from that of the N1 column synchronizing signal. Therefore, the detection mechanism 60 can detect the ink ejection state of each ink 21 even if the moving speed and the ejection cycle of the recording head 20 are the same as those in image recording. Therefore, the image recording apparatus 10 does not have to control injection of the ink and the moving speed of the recording head in particular. That is, in the image recording apparatus 10, the control of the detection mechanism 60 during the inspection is simple, and a mechanism for a special control does not have to be provided.

In addition, since the beam B crosses the ink arrangement direction, the detection mechanism 60 according to this embodiment can detect the ejection state of each nozzle without performing sophisticated positional adjustment of the optical axis of the detection mechanism 60 and the nozzles 21.

Additionally, the image recording apparatus 10 can inspect the ejection state at the moving speed Vk and the ejection cycle T which are the same as those in image recording as mentioned above. Therefore, during the inspection, the moving speed of the recording head 20 is not decreased below that in image recording. Therefore, the detection mechanism 60 can detect the ejection state of the ink at a high speed.

Further, since the image recording apparatus 10 has the angle θ of the beam being set as mentioned above, all the nozzles can be detected in each scanning. Therefore, the image recording apparatus 10 can detect the ejection state of the ink at a high speed.

Furthermore, the ink is ejected from at least one of the above-described nozzle groups in the interval of the ejection cycles of the respective noise groups. Therefore, detection of a plurality of nozzles can be performed in one cycle of the ejection cycles of the respective nozzle groups. Thus, the detection mechanism 60 can detect the ejection state of the nozzles at a higher speed.

Incidentally, in the nozzle ejection state inspection according to this embodiment, a total number of the ink passages of all the nozzle columns is compared with a total number of the nozzles of all the nozzle columns. In place of this, the image recording apparatus 10 can apply any other comparison method in the nozzle ejection state inspection.

For example, the controller 80 can inspect presence/absence of an ejection defect every nozzle column. In this case, the total number of the nozzles in each nozzle column is stored in the ROM 80*d*. Also, the CPU 80*a* counts the number of ink passages of the ink droplet every nozzle column. Then, the CPU 80*a* compares the total number of the nozzles with the total number of ink passages of each ink column every nozzle column. Based on this comparison, the ejection defect of each nozzle column can be detected.

As another comparison method, the CPU 80*a* stores presence/absence of passage of the ink in the RAM 80*c* every position of each nozzle. At this moment, comparison of presence/absence of passage of the ink is carried out every position of each nozzle. In this case, the ejection defect of each nozzle can be detected. Moreover, the CPU 80*a* can store presence/absence of passage of the ink in the RAM 80*c* together with the detection time. In this case, the ejection defect of each nozzle can be also detected.

The image recording apparatus 10 according to this embodiment has two recording heads 20, but it can be configured to have three or more recording heads. In addition, the image recording apparatus 10 according to this embodiment can be constituted by one recording head having two or more nozzle columns arranged in parallel to each other.

Figure 6:
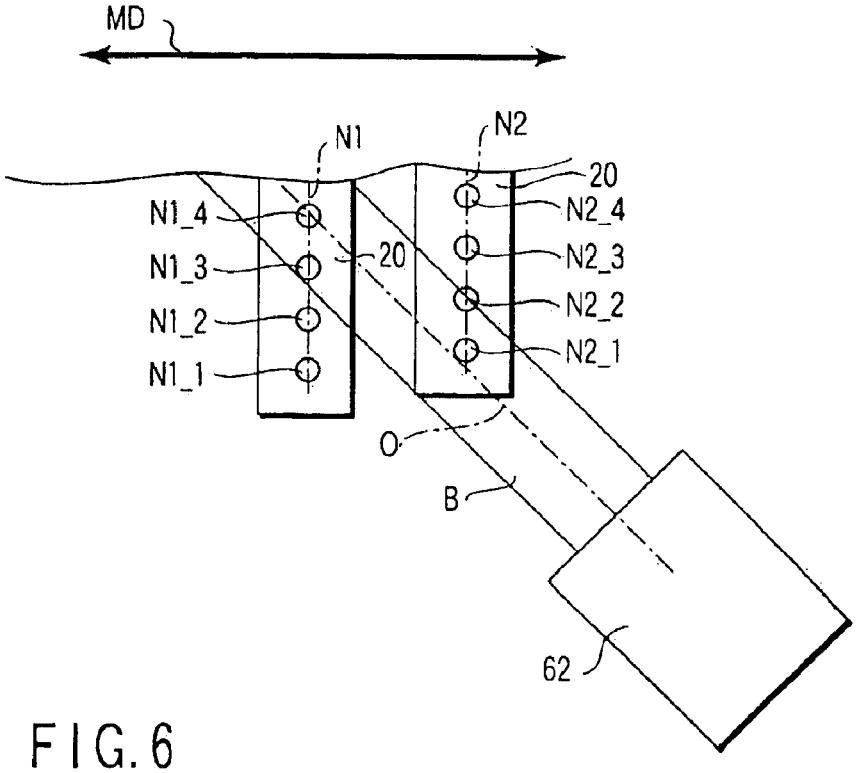
FIG. 6 is a schematic top view showing a modification of the first embodiment.

Additionally, in the image recording apparatus 10 according to this embodiment, the positions of the sub scan directions of the nozzles in the adjacent recording heads 20 are equal to each other. In this embodiment, as shown in FIG. 6, the recording heads 20 adjacent to each other can shift the adjacent heads in the sub scan direction in order to increase the recording density. In this case, the beam B likewise has the width BW. Therefore, all of the ejected ink can be transmitted through the beam B even if the recording heads 20 are operated at the same moving speed Vk and the same ejection cycle T as those in the image recording mode as mentioned above. Therefore, the recording heads having the structure can be inspected by the detection mechanism 60.

It is to be noted that the image recording apparatus 10 according to this embodiment is set in such a manner that the ink droplet can be spotted at a predetermined time or at a predetermined position if injection is normally carried out. Therefore, the image recording apparatus 10 according to this embodiment can also detect the nozzles having the injection angle or the larger angle by utilizing this setting.

Further, in this embodiment, description has been given as to the case where one ink droplet passes through the beam B, but the number of the ink droplets existing in the beam B is not restricted to one. For example, when the ejection timings of the two ink droplets are set in such a manner that the ink droplets from the nozzle N1_3 and the nozzle N2_1 can pass through the beam B in different timings, a quantity of shift of the synchronizing signals are set based on the ejection timings of the two ink droplets and the pulse widths of the respective synchronizing signals are narrowed. As a result, the detection mechanism 60 can sequentially detect the ink droplets passing through the beam.

(Second Embodiment)

Figure 7:
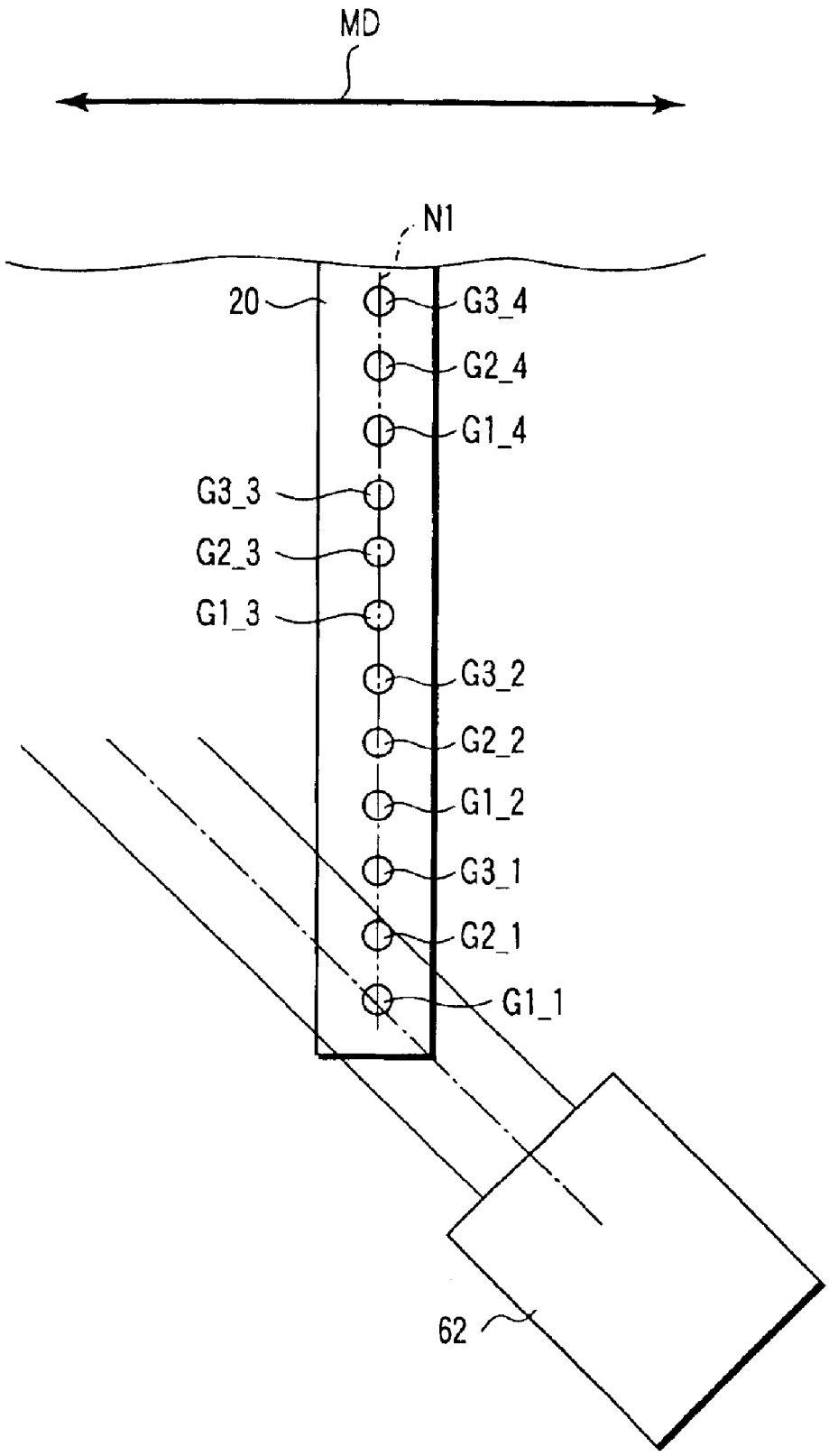
FIG. 7 is a schematic top view showing a recording head according to a second embodiment.

An image recording apparatus 10 according to a second embodiment will now be described with reference to FIGS. 7 and 8. It is to be noted that the constituent members similar to those in the image recording apparatus 10 according to the first embodiment are denoted by reference numerals designating the same constituent members of this image recording apparatus 10 in this embodiment, thereby omitting the detailed explanation. The image recording apparatus 10 according to the second embodiment has only one recording head 20 as different from the first embodiment. Furthermore, in the image recording apparatus 10 according to this embodiment, the operation of the controller 80 in the ink ejection state inspection is different.

The image recording apparatus 10 according to this embodiment is different from the first embodiment, and the nozzles in the same nozzle column is divided into groups. Moreover, the ejection timings of these groups are different from each other. More specifically, as to the respective nozzles 21 in the nozzle column N1, the nozzle G1_1 at the end of the light source 62 side and every third nozzles are determined to belong to a first nozzle group, the nozzle G1_2 and every third nozzles are determined to belong to a second nozzle group, and the nozzle G1_3 and every third nozzles are determined to belong to a third nozzle group.

Figure 8:
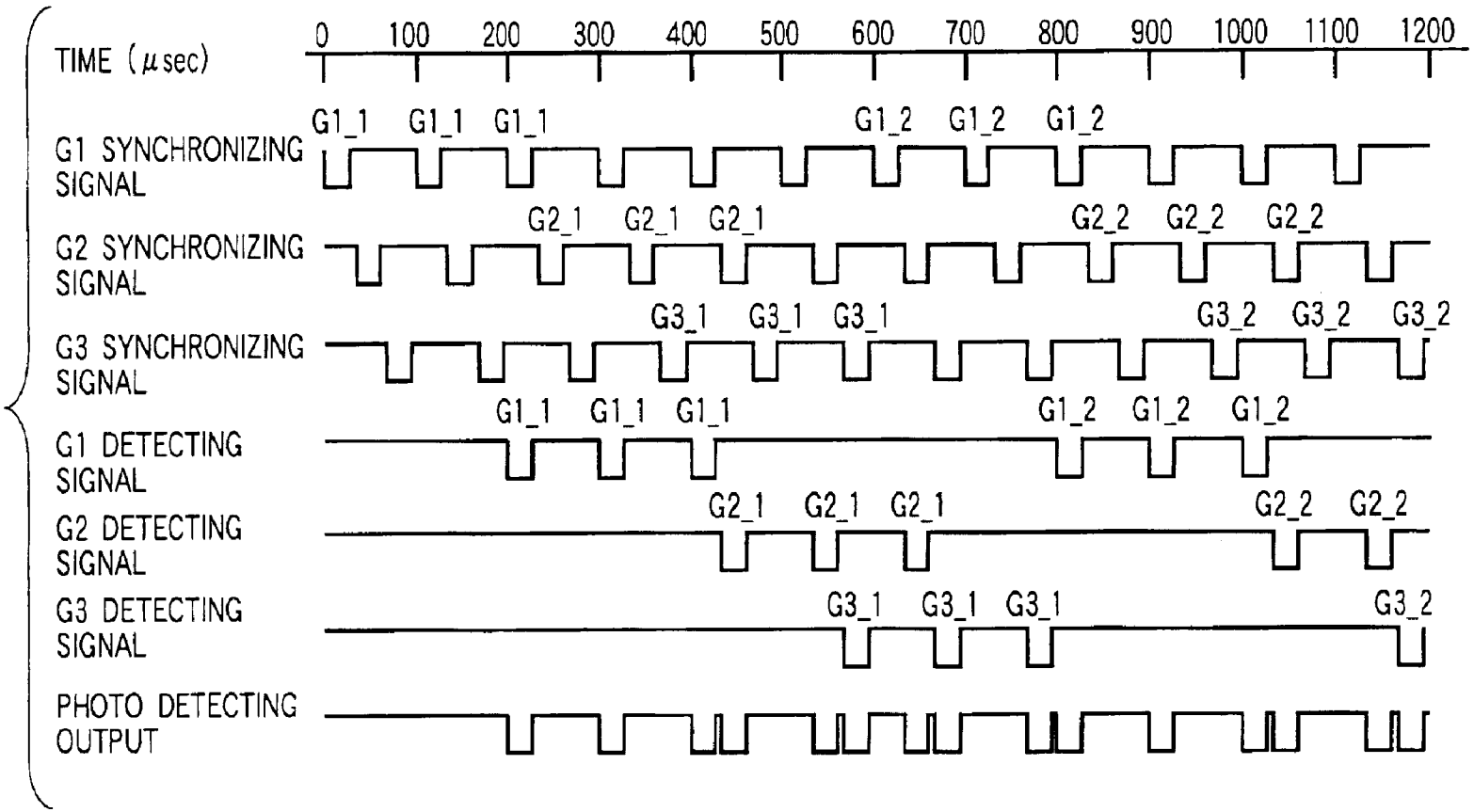
FIG. 8 is a view showing each of a synchronizing signal, a detecting signal and a photo detecting output of an image recording apparatus according to the second embodiment.

The ink ejection cycle of the first nozzle group is determined based on a G1 synchronizing signal illustrated in FIG. 8. Similarly, the ink ejection cycle T of the second nozzle group is determined based on a G2 synchronizing signal, and the same of the third nozzle group is determined based on a G3 synchronizing signal. It is to be noted that each of the first, second and third nozzle groups is shifted from the group which ejects the ink before itself by a time To so as not to interfere with each other in the ejection state inspection. The time To can be obtained based on the following expression 11. It is to be noted that X in the following expression indicates the number of groups.

$$To=T/X \quad \text{(Expression 11)}$$

In this embodiment, since the ejection cycle T is 100 μsec and the number of groups is three, the time To is approximately 33 μsec.

It is to be noted that the ink detection time of each nozzle is set to a passage time Tt obtained from the expression 8 as described in the first embodiment. Therefore, when the number of ink droplets existing in the beam B during the inspection is restricted to one, the time To which is a quantity of shift of the ejection cycle of each group must be larger than the time Tt. In other words, when the detection time of the ink droplet of each nozzle is smaller than the ejection cycle, the time To has an error tolerance of a time Td obtained as follows. The time Td can be obtained from the following expression 12:

$$Td=To-Tt \quad \text{(Expression 12)}$$

It is to be noted that, in this embodiment, the passage time Tt is approximately 28 μsec as similar to the first embodiment. Therefore, based on the expression 12, the error tolerance of the time To is approximately 5 μsec.

Furthermore, as different from the first embodiment, in the image recording apparatus according to this embodiment, each nozzle ejects the ink for a plurality of number of times while the ink flying path is crossing the beam B. Therefore, the detection mechanism 60 detects a plurality of number of times of ejection while the ink flying path is crossing the beam B. In this embodiment, each nozzle ejects the ink for three times.

The operation of the image recording apparatus 10 according to this embodiment will now be described.

The image recording apparatus 10 according to this embodiment ejects the ink based on each synchronizing signal in FIG. 8. It is to be noted that each group first ejects the ink from the same nozzle in three cycles and pauses in three cycles. This operation is repeated. In this manner, each group ejects the ink, and the ejection cycles of the respective groups are different from each other. Therefore, there is no such an interference as that the two ink droplets simultaneously pass through the beam B.

Furthermore, in the image recording apparatus 10 according to this embodiment, three types of passage information relative to the respective nozzles are transmitted to the CPU 80*a*. Therefore, the CPU 80*a* calculates an average of the three types of the passage information. At this moment, the CPU 80*a* adds 1 to the total number of the ink passages when the number of ink passages is large in each nozzle. Concretely, the CPU 80*a* adds 1 to the total number of ink passages when an average value is not less than a predetermined value in each nozzle. More specifically, when two out of three types of the passage information are indicative of passage, the CPU 80*a* determines that the target nozzle does not have the ejection defect. In this case, the predetermined value is set to approximately 0.66.

The total number of ink passages of all the nozzles is recorded in the RAM 80*c*. When all the nozzles have normally ejected the ink, the total number of the ink passages becomes equal to the total number of nozzles which is a sum of all the nozzles. Therefore, the CPU 80*a* detects presence/absence of the ink ejection defect by comparing the total number of ink passages with the total number of nozzles. In this manner, since the image recording apparatus 10 according to this embodiment can inspect each nozzle for a plurality of number of times, the ink ejection state can be further correctly inspected even if there are irregularities in the detecting signals.

It is to be noted that the image recording apparatus 10 according to this embodiment can store the passage information for each position of each nozzle in the RAM 80*c* and compare presence/absence of passage of the ink every position of each nozzle. Moreover, the CPU 80*a* can store presence/absence of passage of the ink in the RAM 80*c* together with the detection time. In this case, the image recording apparatus 10 can likewise detect the ejection defect every nozzle.

In addition, in the image recording apparatus 10 according to this embodiment, three types of the passage information corresponding to the respective nozzles are supplied to the CPU 80*a*. By combining respective values in the three types of the passage information, one characteristic value can be generated. This characteristic value is recorded and can be used for the ejection state inspection. That is, the image recording apparatus 10 can use these three types of the passage information for the ejection state inspection without averaging them. More concretely, the value of the passage information is set to "1" when the ink has passed and set to "0" when the ink has not passed. When the nozzle G1_1 at the end of the recording head 20 has ejected the ink for three times, it is intentionally controlled so as not to eject the ink for the second time. With this control, the CPU 80*a* receives the passage information "101". A position specification value indicative of the nozzle at the end is recorded in the ROM 80*d*. This position specification value is a three-digit numeric character consisting of 0 and 1 as similar to the above-described characteristic. The position specification value of the end portion is set to "101" as similar to the passage information.

The CPU 80*a* compares the passage information with the position specification value. In the above-described comparison, if the two values are equal to each other, it can be determined that the inspected nozzle is the nozzle at the end portion. In this case, the image recording apparatus 10 can assuredly discover the nozzle at the end portion based on the recorded passage information. Therefore, a position of any other nozzle can be readily determined based on this nozzle at the end portion. Therefore, when the characteristic value is used, the position of the nozzle in the ejection defective state can be readily found without recording the passage information in the RAM 80*c* together with each nozzle position or the time. It is to be noted that, when all the ink droplets ejected from the respective nozzles other than the nozzle at the end portion have passed through the beam B, the CPU 80*a* receives a characteristic value "111" consisting of the passage information. Therefore, the CPU 80*a* does not determine the nozzles other than the nozzle at the end portion as the nozzle at the end portion.

Figure 9:
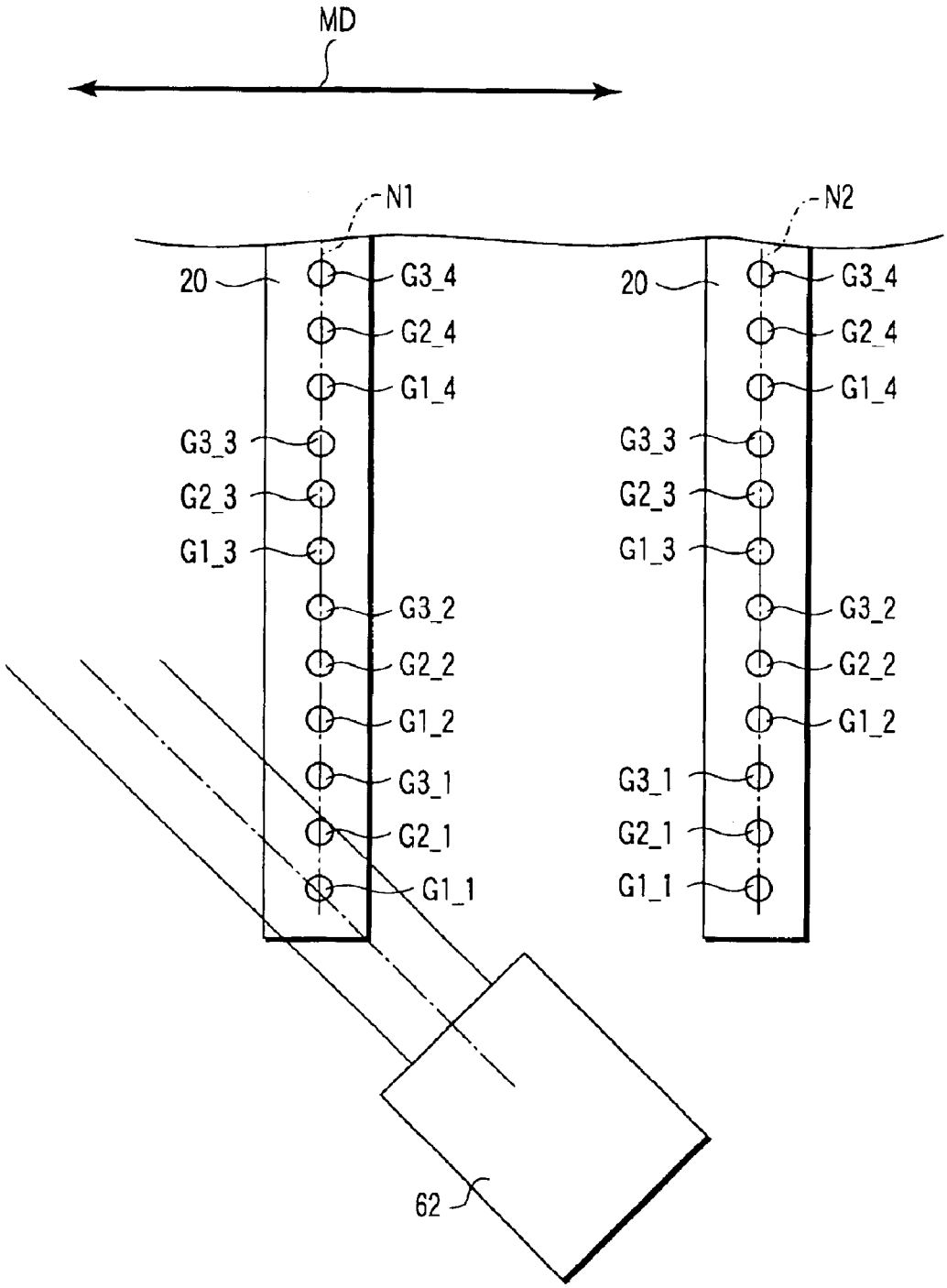
FIG. 9 is a schematic top view showing a recording head according to a modification of the second embodiment.

Moreover, although the image recording apparatus 10 according to this embodiment is configured to have one recording head 20, it may have a plurality of recording heads. For example, as shown in FIG. 9, it may have two recording heads 20.

Figure 10:
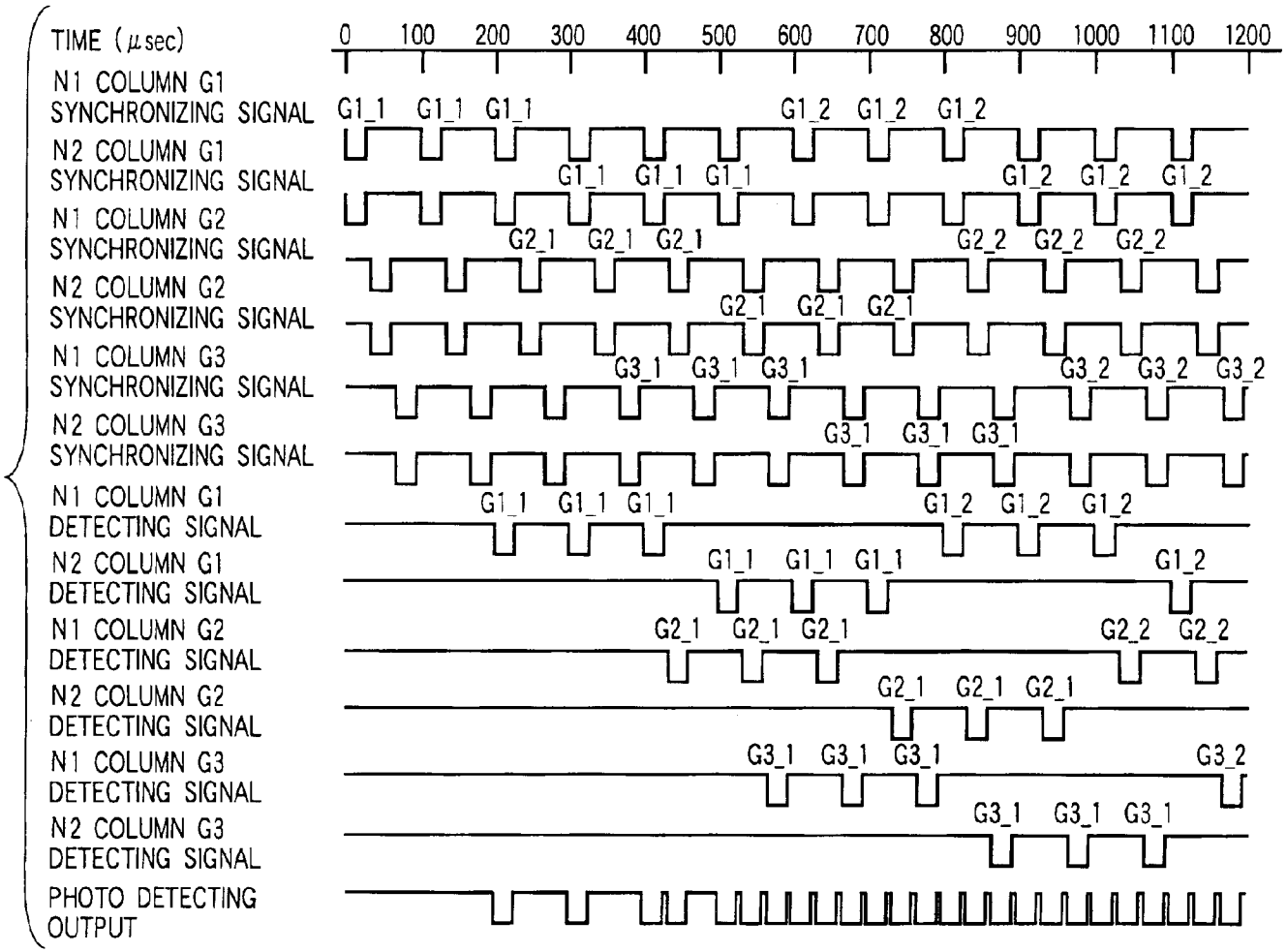
FIG. 10 is a view showing each of a synchronizing signal, a detecting signal and a photo detecting output of a modification of the image recording apparatus according to the second embodiment.

In this case, in the nozzle column N1 and the nozzle column N2, three groups G1, G2 and G3 are created in the order from the leading nozzle as similar to the case of one recording head 20 mentioned above. Then, the respective groups G1, G2 and G3 in each of the nozzle columns N1 and N2 selectively eject the ink based on the synchronizing signal in FIG. 10 as similar to the case of one recording head 20. Here, although the synchronizing signals are equal to each other in the same group in the nozzle columns N1 and N2 (for example, G1 in the nozzle column N1 and G1 in the is nozzle column N2), the ejection timings of the ink are shifted from each other.

At first, the ink is ejected from the first nozzle G1_1 in the group G1 of the nozzle column N1 for the three times. After the third ejection of the ink, the second nozzle G2_1 ejects the ink for three times when the time To (approximately 33 μsec) has elapsed.

After the second ejection of the ink, the third nozzle G3_1 ejects the ink for three times when the time To (approximately 33 μsec) has likewise elapsed.

In addition, after the third ejection of the ink from the nozzle G1_1 in the nozzle column N1, the first nozzle G1_1 in the group G1 of the nozzle column N2 ejects the ink for three times when 100 μsec which is the ink ejection cycle T has elapsed. After the third ejection of the ink, the second nozzle G2_1 ejects the ink for three times when the time To (approximately 33 μsec) has elapsed. Additionally, after the second ejection of the ink, the third nozzle G3_1 ejects the ink for three times when the time To (approximately 33 μsec) has likewise elapsed.

When 100 μsec has elapsed after the third ink ejection by the nozzle G1_1 in the nozzle column N2 (when the next G1 synchronizing signal is transmitted), the second nozzle G1_2 in the group G1 ejects the ink for three times, and the above-described ink ejection operation is thereafter repeated.

That is, in the image recording apparatus 10 according to this embodiment, the respective nozzle columns do not eject the ink in the same timing. Also, the ejection timing of each of the nozzle groups G1, G2 and G3 in the respective nozzle columns is shifted from the group which precedently ejects the ink by the time To.

By ejecting the ink in this manner, the image recording apparatus 10 according to this embodiment can eject the ink droplets of the respective nozzles without causing interference of the ink droplets. Therefore, this image recording apparatus 10 has a plurality of the recording heads, but one characteristic value obtained by combining the values of three types of the passage information is recorded and it can be used for the ejection state inspection.

It is to be noted that the above-described image recording apparatus is a so-called serial scan type ink jet printer which records an image while reciprocating the recording heads in a direction orthogonal to the paper transferring direction. The ink detection mechanism according to the present invention is not applied to only this serial scan type ink jet printer.

For example, the above-described detection mechanism can be applied to a so-called full-line type ink jet printer such as disclosed in Jpn. Pat. Appln. KOKAI Publication No. 120386/2002 or 205872/2001.

The full-line type ink jet printer has the recording head with a print width corresponding to a paper width. This recording head extends over the entire paper widthwise direction. Therefore, the full-line type ink jet printer can record the entire image in one pass. That is, in the full-line type ink jet printer, the image to be recorded on the recording medium is sequentially recorded over the entire paper width of the paper. Therefore, as different from the serial scan type printer, the full-line type ink jet printer can not fully move the recording head in the direction parallel to the recording medium surface. Thus, in case of the full-line type ink jet printer, the ejection state inspection of the ink of each nozzle in the recording head is carried out by scanning the detection mechanism having the light source and the photo detector with respect to the fixed recording head.

Figure 11A:
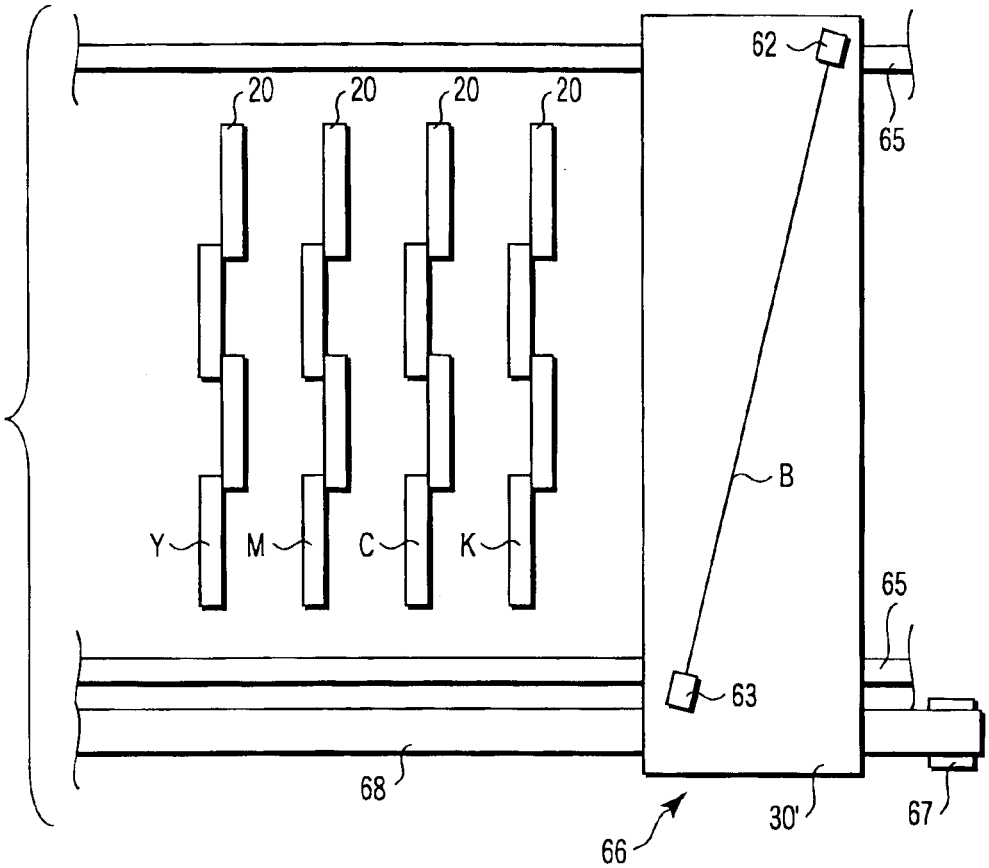
FIG. 11A is a schematic top view showing an image recording apparatus which is of a full-line type.
Figure 11B:
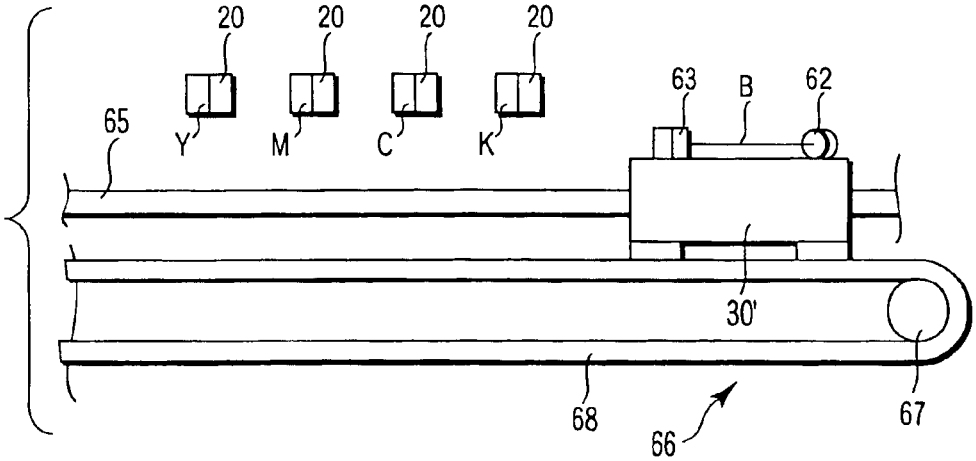
FIG. 11B is a schematic side view showing the image recording apparatus depicted in FIG. 11A.
Figure 12:
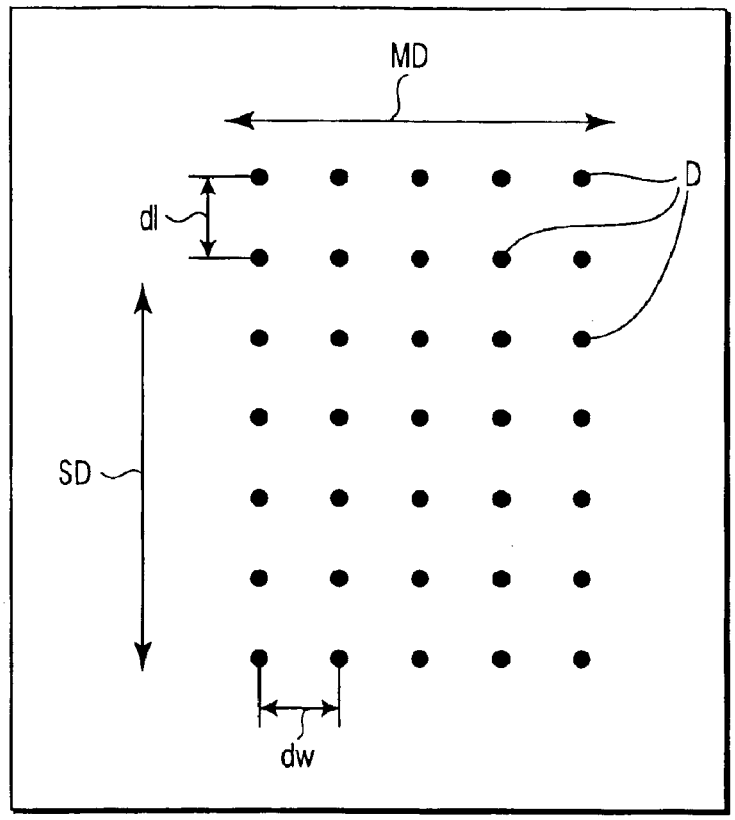
FIG. 12 PRIOR ART
FIG. 12 is a schematic view showing arrangement of ink dots recorded by a general image recording apparatus.
Figure 15:
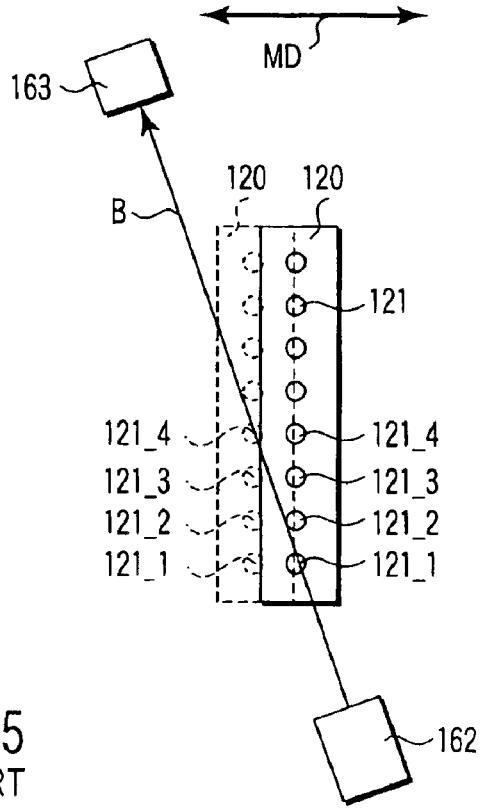
FIG. 15 PRIOR ART
FIG. 15 is a schematic top view showing an operation of a detection mechanism in still another conventional image recording apparatus.
Figure 13A:
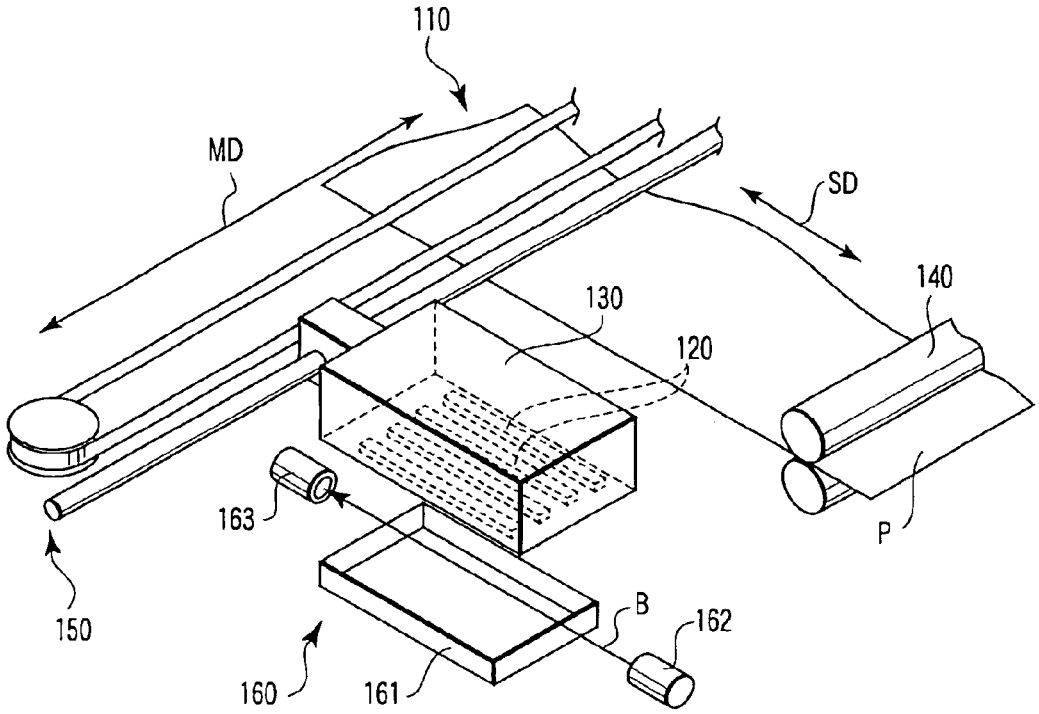
FIG. 13A PRIOR ART
FIG. 13A is a schematic perspective view showing a conventional image recording apparatus.
Figure 13B:
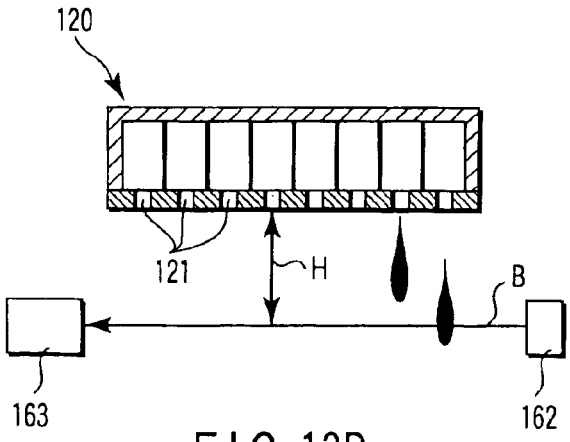
FIG. 13B PRIOR ART
FIG. 13B is a schematic cross-sectional view showing a detection mechanism in FIG. 13A.
Figure 13C:
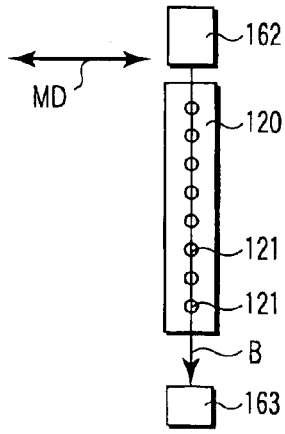
FIG. 13C PRIOR ART
FIG. 13C is a schematic top view showing a recording head in FIG. 13A.
Figure 14A:
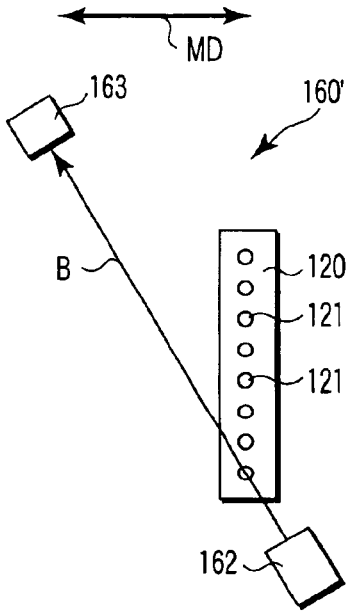
FIG. 14A PRIOR ART
FIG. 14A is a schematic top view showing the relationship between a nozzle column and a beam in another conventional image recording apparatus.
Figure 14B:
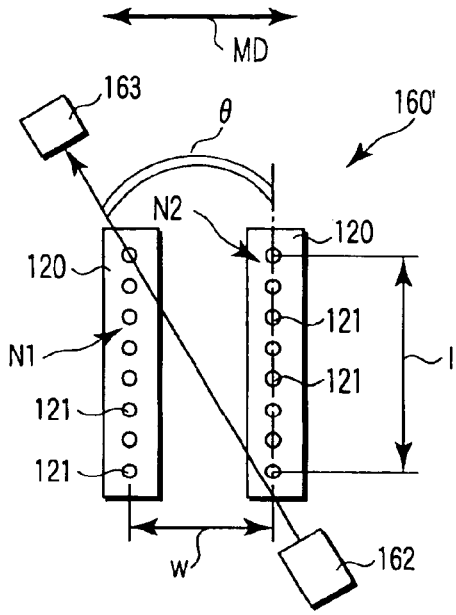
FIG. 14B PRIOR ART
FIG. 14B is a schematic top view showing a recording head in FIG. 14A.
Figure 14C:
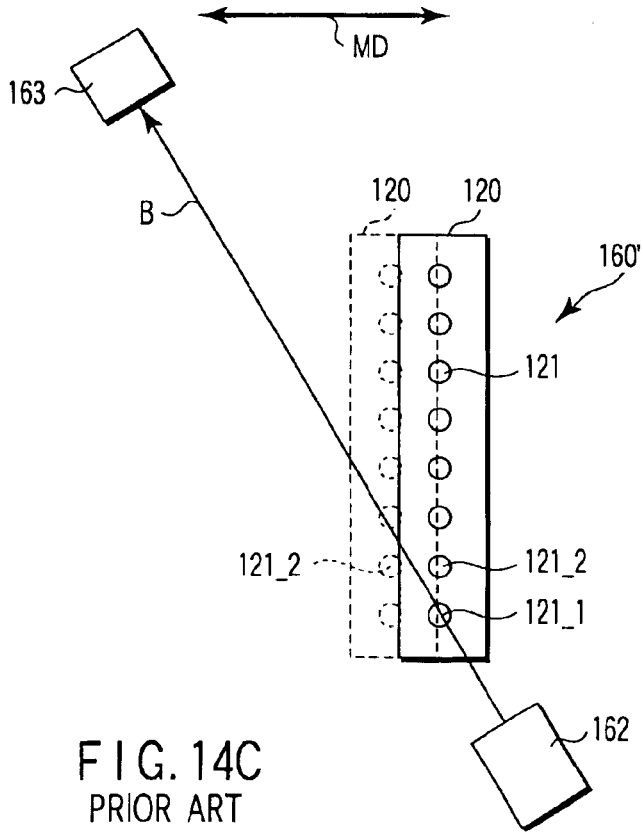
FIG. 14C PRIOR ART
FIG. 14C is a schematic top view showing an operation of a detection mechanism in FIG. 14A.

The full-line type ink jet printer having the detection mechanism will now be described with reference to FIGS. 11A and 11B. FIG. 11A is a schematic top view showing the full-line type ink jet printer. FIG. 11B is a schematic side view showing the ink jet printer depicted in FIG. 11A.

The detection mechanism 60 illustrated in FIGS. 11A and 11B has the light source 62 and the photo detector 63 as similar to the first embodiment. This detection mechanism 60 also has a scanning mechanism used for moving the light source 62 and the photo detector 63.

The operation mechanism has a carriage 30' which holds the light source 62 and the photo detector 63, a guide 65 which movably supports the carriage 30', and driving means 66. The driving means 66 has an endless belt 68 stretched to a drive pulley and a driven pulley (not shown).

The carriage 30' is fixed on the endless belt. On the carriage 30', the light source 62 is arranged on one end side along the extending direction of the recording head 20, and the photo detector 63 is arranged on the other end side. The photo detector 63 is arranged on the optical axis of the light source 62. The light source 62 is, for example, a semiconductor laser.

The light source 62 is arranged in such a manner that the optical axis is inclined with respect to the extending direction of the recording head 20. An angle of the light source 62 relative to the extending direction of the recording head 20 is set equal to the angle θ illustrated in the first embodiment. In FIG. 11, as an example, the angle of the optical axis relative to the extending direction of the recording head 20 is set to approximately 70 degrees.

The guide 65 extends along the transferring direction (right-and-left direction in FIGS. 11A and 11B) of the recording medium.

The carriage 30' can move along the extending direction of the guide. That is, the carriage 30' can move along the transferring direction of the recording medium.

The drive pulley 67 and the driven pulley are arranged so as to be capable of stretching the endless belt along the transferring direction of the recording medium. The drive pulley 67 provides the drive force to the endless belt. Therefore, the carriage 30' fixed on the endless belt 68 as mentioned above moves along the transferring direction of the recording medium in accordance with drive by the drive pulley 67.

The operation of the ejection state inspection by the ink jet printer having the above structure will now be described.

In the ejection state inspection, the carriage 30' is moved from a position shown in FIGS. 11A and 11B toward the left side in the drawings. That is, the carriage 30' moves toward the recording head along the transferring direction of the recording medium. In this movement, the beam B from the light source 62 sequentially crosses the ink flying paths of the respective nozzles in the recording head for a K (black) ink, the recording head for a C (cyan) ink, the recording head for an M (magenta) ink and the recording ink for a Y (yellow) ink. Therefore, in such a full-line type ink jet printer, the detection mechanism 60 can perform the ink ejection state inspection as similar to the first and second embodiments.

It is to be noted that the recording heads can move in the direction orthogonal to the recording medium surface for maintenance in the full-line type ink jet printer. For example, the movable structure is illustrated in the recording head disclosed in Jpn. Pat. Appln. KOKAI Publication No. 120386/2002.

Such a recording head is held to be sufficiently close to the recording medium surface in image recording. Further, the recording head is set to be sufficiently away from the recording medium surface during maintenance.

As shown in FIG. 11B, the detection mechanism 60 has a predetermined dimension in the direction orthogonal to the recording medium surface. This dimension is larger than a gap between the recording head 20 and the recording medium surface during image recording. Therefore, in the ink ejection state inspection, a space larger than this dimension is required between the recording head 20 and the recording medium surface in the direction orthogonal to the recording medium surface.

The recording head 20 during maintenance is moved away from the recording medium surface more than the above-described dimension in the direction orthogonal to the recording medium surface. Therefore, in the ink ejection state inspection, the recording head is moved away to a position in the maintenance mode. With the above-described structure and operation, the detection mechanism 60 can perform the ejection state inspection of the ink droplet without interfering with the recording head 20.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. An ink jet recording apparatus comprising:

an ink jet recording head which includes a plurality of nozzles divided into a plurality of groups and which is adapted to elect ink from the plurality of nozzles;

a carriage on which the ink jet recording head is mounted, and which is driven to reciprocate in a direction orthogonal to a transferring direction of a recording medium;

a sensor which is provided in a drive range of the carriage and such that an optical axis of detection light of the sensor is inclined with respect to a moving direction of the carriage, said sensor optically detecting the ink ejected from each of the plurality of nozzles; and a controller which controls an ejection operation of the ink jet recording head, inspects an ejection state of the ink from the plurality of nozzles based on an output of the sensor, and shifts ink ejection timings of the plurality of groups with respect to each other when inspecting the ink ejection state, wherein a shifting time of the ink ejection timings of the plurality of groups is shorter than one ejection cycle in each of the plurality of groups in image recording.

2. The ink jet recording apparatus according to claim 1, wherein the controller sequentially changes the nozzles which eject the ink in each of the plurality of groups.

3. The ink jet recording apparatus according to claim 2, wherein the controller causes one nozzle to eject the ink a plurality of times.

4. The ink jet recording apparatus according to claim 3, wherein the controller sets an ink ejection mode of a reference nozzle to be different from an ink ejection mode of all other nozzles.

5. The ink jet recording apparatus according to claim 1, wherein the controller sets ink ejection cycles to be the same for each of the plurality of groups when inspecting the ink ejection state.

6. The ink jet recording apparatus according to claim 1, wherein the controller sets ink ejection cycles of the plurality of groups to be the same in image recording and when inspecting the ink ejection state.

7. The ink jet recording apparatus according to claim 1, wherein the controller controls the ink ejection timing of each of the plurality of groups such that ejection of the ink from a first group and ejection of the ink from a second group are alternately carried out.

8. The ink jet recording apparatus according to claim 1, wherein the controller controls the ink ejection timings such that the ink is ejected from a nozzle in each of the plurality of groups within one ink ejection cycle of the first group after the ink is ejected from the first group.

9. The ink jet recording apparatus according to claim 1, wherein, assuming that a quantity of the groups is X and the ink ejection cycle is T seconds, the controller controls the ink ejection timings such that the ink ejection cycle of each of the plurality of groups is shifted from an ejection cycle of a group which has precedently ejected the ink by T/X seconds.

10. The ink jet recording apparatus according to claim 1, wherein the controller sets the shifting time Tz as follows:

$$Tt<Tz<T-Tt$$

where:

Tt is the time required for the ink to pass through the detection light; and

T is the ink ejection cycle.

11. The ink jet recording apparatus according to claim 1, wherein a moving speed of the carriage when inspecting the ink ejection state is set to be equal to a moving speed in image recording.

12. The ink jet recording apparatus according to claim 11, wherein the drive range of the carriage includes a constant speed drive area in which the carriage is driven at a constant speed and a reversing drive area in which the carriage is driven to be reversed, and the sensor is provided in the fixed speed drive area.

13. The ink jet recording apparatus according to claim 1, wherein the detection light is inclined with respect to the drive direction of the carriage by 45 degrees.

14. The ink jet recording apparatus according to claim 1, wherein the sensor detects the ink ejection state in a detection timing based on the ink ejection timing of each of the plurality of groups.

15. An ink jet recording apparatus comprising:

a plurality of ink jet recording heads each of which includes a substantially linear nozzle column including a plurality of nozzles;

a carriage on which the plurality of ink jet recording heads are mounted such that the plurality of ink jet recording heads are arranged along a direction orthogonal to a recording medium transferring direction and such that the nozzle columns thereof are arranged along the recording medium transferring direction, and a drive direction of the carriage being orthogonal to the recording medium transferring direction;

a sensor which is provided in a drive range of the carriage such that an angle of detection light of the sensor is inclined at an angle so as to cross the plurality of nozzle columns when the nozzle columns move past the sensor, and which optically detects ink ejected from the plurality of nozzle columns; and a controller which controls an ink ejection operation of the plurality of ink jet recording heads, inspects an ejection state of the ink based on an output of the sensor, and shifts ink ejection timings of the plurality of nozzle columns with respect to each other when inspecting the ink ejection state, wherein a shifting time of the ink election timings of the plurality of nozzle columns is shorter than one ejection cycle in each of the nozzle columns in image recording.

16. The ink jet recording apparatus according to claim 15, wherein the controller sequentially changes the nozzles which eject the ink in each of the plurality of nozzle columns.

17. The ink jet recording apparatus according to claim 16, wherein the controller causes one nozzle to eject the ink a plurality of times.

18. The ink jet recording apparatus according to claim 17, wherein the controller sets an ink ejection mode of a reference nozzle to be different from an ink ejection mode of all other nozzles in the nozzle column.

19. The ink jet recording apparatus according to claim 15, wherein the controller sets ink ejection cycles to be the same for each of the plurality of nozzle columns when inspecting the ink ejection state.

20. The ink jet recording apparatus according to claim 15, wherein the controller sets ink ejection cycles of the plurality of nozzle columns to be the same in image recording and when inspecting the ink ejection state.

21. The ink jet recording apparatus according to claim 15, wherein the controller controls the ink ejection timing of each of the plurality of nozzle columns such that an ink ejection operation from a nozzle of a first nozzle column and an ink ejection operation from a nozzle of a second nozzle column adjacent to the first nozzle column are alternately carried out.

22. The ink jet recording apparatus according to claim 15, wherein the controller controls the ink ejection timings such that the ink is ejected from the nozzle of the second nozzle column within one ink ejection cycle of the first nozzle column after the ink is ejected from the first nozzle column.

23. The ink jet recording apparatus according to claim 15, wherein, assuming that a quantity of the nozzle columns is X and the ink ejection cycle is T seconds, the controller controls the ink ejection timings such that the ink ejection cycle of each of the plurality of nozzle columns is shifted from an ejection cycle of a nozzle column which has precedently ejected the ink by T/X seconds.

24. The ink jet recording apparatus according to claim 15, wherein the controller sets the shifting time Tz as follows:

$$Tt<Tz<T-Tt$$

where:

Tt is the time required for the ink to pass through the detection light,

T is the ink ejection cycle.

25. The ink jet recording apparatus according to claim 15, wherein a moving speed of the carriage when inspecting the ink ejection state is set to be equal to a moving speed in image recording.

26. The ink jet recording apparatus according to claim 25, wherein the drive range of the carriage includes a constant speed drive area in which the carriage is driven at a constant speed and a reversing drive area in which the carriage is operated to be reversed, and the sensor is provided in the constant speed drive area.

27. The ink jet recording apparatus according to claim 15, wherein the detection light is inclined with respect to a drive direction of the carriage by 45 degrees.

28. The ink jet recording apparatus according to claim 15, wherein the sensor detects the ink ejection state in a detection timing based on the ink ejection timing of each of the plurality of nozzle columns.

29. An ink jet recording apparatus comprising:

an ink jet recording head having a substantially linear nozzle column including a plurality of nozzles divided into a plurality of groups;

a sensor which is provided such that detection light thereof is inclined at an angle so as to cross the nozzle column, and which detects passage of ink when ink ejected from each of the plurality of nozzles crosses the detection light; and a controller which controls an ink ejection operation of the ink jet recording head, relatively moves the ink jet recording head and the sensor, inspects an ink ejection state of the ink from the plurality of nozzles of the nozzle column based on an output of the sensor, and shifts ink ejection timings of the plurality of groups with respect to each other when inspecting the ink ejection state, wherein a shifting time of the ink injection timings of the plurality of groups is shorter than one ejection cycle of each of the groups in image recording.

30. The ink jet recording apparatus according to claim 29, wherein the controller sequentially changes a nozzle which ejects the ink in each of the plurality of groups.

31. The ink jet recording apparatus according to claim 30, wherein the controller causes one nozzle to eject the ink a plurality of times.

32. The ink jet recording apparatus according to claim 31, wherein the controller sets an ink ejection mode of a reference nozzle of each of the plurality of groups to be different from an ink ejection mode of all other nozzles in the group.

33. The ink jet recording apparatus according to claim 29, wherein the controller sets ink ejection cycles to be the same for each of the plurality of groups when inspecting the ink ejection state.

34. The ink jet recording apparatus according to claim 29, wherein the controller sets the ink ejection cycles of each of the plurality of groups to be the same in image recording and when inspecting the ink ejection state.

35. The ink jet recording apparatus according to claim 29, wherein, assuming that a quantity of the groups is X and the ink ejection cycle is T seconds, the controller controls the ink ejection timings such that the ink ejection cycle of each of the plurality of groups is shifted from an ejection cycle of a group which has precedently ejected the ink by T/X seconds.

36. The ink jet recording apparatus according to claim 29, wherein the controller sets the shifting time Tz as follows:

$$Tt<Tz<T-Tt$$

where:

Tt is the time required for the ink to pass through the detection light,

T is the ink ejection cycle.

37. The ink jet recording apparatus according to claim 29, wherein the detection light is inclined by 45 degrees with respect to a drive direction of a carriage on which the ink jet recording head is mounted.

38. The ink jet recording apparatus according to claim 29, wherein the sensor detects the ink ejection state in a detection timing based on the ink ejection timing of each of the plurality of groups.

* * * * *